US012624854B1

(12) United States Patent
Risbeck et al.

(10) Patent No.: US 12,624,854 B1
(45) Date of Patent: May 12, 2026

(54) HVAC SYSTEMS WITH START TIME OPTIMIZATION

(71) Applicant: Tyco Fire & Security GmbH, Neuhausen am Rheinfall (CH)

(72) Inventors: Michael J. Risbeck, West Chester, OH (US); Camille M. Aucoin, Milwaukee, WI (US); Benjamin J. Sveum, Hampden, ME (US); Christopher R. Amundson, Grafton, WI (US); Matthew J. Asmus, Watertown, WI (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 0 days.

(21) Appl. No.: 19/009,100

(22) Filed: Jan. 3, 2025

(51) Int. Cl.

| | |
|---|---|
| ***F24F 11/46*** | (2018.01) |
| ***F24F 11/65*** | (2018.01) |
| ***F24F 110/10*** | (2018.01) |
| ***F24F 110/70*** | (2018.01) |
| ***F24F 120/10*** | (2018.01) |
| ***F24F 140/50*** | (2018.01) |

(52) U.S. Cl.
CPC ..... *F24F 11/46* (2018.01); *F24F 11/65* (2018.01); *F24F 2110/10* (2018.01); *F24F 2110/70* (2018.01); *F24F 2120/10* (2018.01); *F24F 2140/50* (2018.01)

(58) Field of Classification Search
None
See application file for complete search history.

(56) References Cited

U.S. PATENT DOCUMENTS

| | | | |
|---|---|---|---|
| 4,522,336 | A | 6/1985 | Culp |
| 4,660,759 | A | 4/1987 | Barnard et al. |
| 4,897,798 | A | 1/1990 | Cler |
| 5,025,984 | A | 6/1991 | Bird et al. |

(Continued)

OTHER PUBLICATIONS

Alcala et al., "A Genetic Rule Weighting and Selection Process for Fuzzy Control of Hearing, Ventilating and Air Conditioning Systems," 2005, Engineering Applications of Artificial Intelligence, vol. 18 (pp. 279-296).

(Continued)

*Primary Examiner* — Thomas C Lee
*Assistant Examiner* — Anzuman Sharmin
(74) *Attorney, Agent, or Firm* — Foley & Lardner LLP

(57) ABSTRACT

A heating, ventilating, or air conditioning (HVAC) system that operates equipment to affect a physical property of an environment. The HVAC system obtains schedules including two time periods during which a criterion for the physical property of a environment is to be satisfied (for example, occupied time periods) and a third time period occurring between the two time periods during which the criterion need not be satisfied (for example, unoccupied time periods). The HVAC system performs one prediction of the physical property forward from the end of the middle time period and one prediction backward from the last of the three time periods to determine a transition period during the second time period within which to operate the equipment by finding an intersection of the predictions. The HVAC system controls the equipment during the transition time period to satisfy the criterion at the beginning of the last time period.

20 Claims, 13 Drawing Sheets

(56) References Cited

U.S. PATENT DOCUMENTS

| | | | | |
|---|---|---|---|---|
| 5,219,119 | A | 6/1993 | Kasper et al. | |
| 5,270,952 | A | 12/1993 | Adams et al. | |
| 5,402,333 | A | 3/1995 | Cardner | |
| 6,594,554 | B1 | 7/2003 | Seem et al. | |
| 7,099,748 | B2 * | 8/2006 | Rayburn | F24F 11/62 165/238 |
| 11,215,375 | B2 | 1/2022 | Alanqar et al. | |
| 11,803,174 | B2 | 10/2023 | Elbsat et al. | |
| 2005/0267606 | A1 | 12/2005 | Bartlett et al. | |
| 2008/0099570 | A1 | 5/2008 | Krebs et al. | |
| 2012/0305661 | A1 | 12/2012 | Malchiondo et al. | |
| 2015/0253706 | A1 * | 9/2015 | Chikazawa | G03G 15/2039 399/69 |
| 2015/0316907 | A1 * | 11/2015 | Elbsat | G05B 19/418 |
| 2019/0024925 | A1 * | 1/2019 | Wu | G05B 19/042 |
| 2021/0055012 | A1 * | 2/2021 | Rigg | F24F 11/61 |
| 2021/0278102 | A1 * | 9/2021 | Sabat | F24F 11/77 |

OTHER PUBLICATIONS

Fadell, T., "The Next Generation Nest Thermostat," Oct. 2, 2012 (8 pages).

Final Office Action on U.S. Appl. No. 16/548,552 dated Oct. 2, 2020, 21 pages.

Moon et al., "Application of Ann (Artificial-Neural-Network) in Residential Thermal Control," 2009, International Building Performance Simulation Association, Eleventh International IBPSA Conference, Glasgow, Scotland, Jul. 27-30, 2009 (8 pages).

Non-Final Office Action on U.S. Appl. No. 16/548,552 dated Apr. 9, 2020, 25 pages.

Notice of Allowance on U.S. Appl. No. 16/548,552 dated Jan. 22, 2021, 10 pages.

Saitta, S., "Standardization vs. normalization," URL: http://www.dataminingblog.com/standardization-vs-normalization/, Jul. 10, 2007 (2 pages).

US Notice of Allowance on U.S. Appl. No. 14/107,978 dated Apr. 4, 2017. 9 pages.

US Notice of Allowance on U.S. Appl. No. 14/107,978 dated Jul. 19, 2017. 2 pages.

US Office Action on U.S. Appl. No. 14/107,978 dated Sep. 23, 2016. 26 pages.

Yang et al., "Application of Artificial Neural Network to Predict the Optimal Start Time for Heating System in Building," Energy Conversion and Management, 2003, vol. 44 (pp. 2791-2809).

* cited by examiner

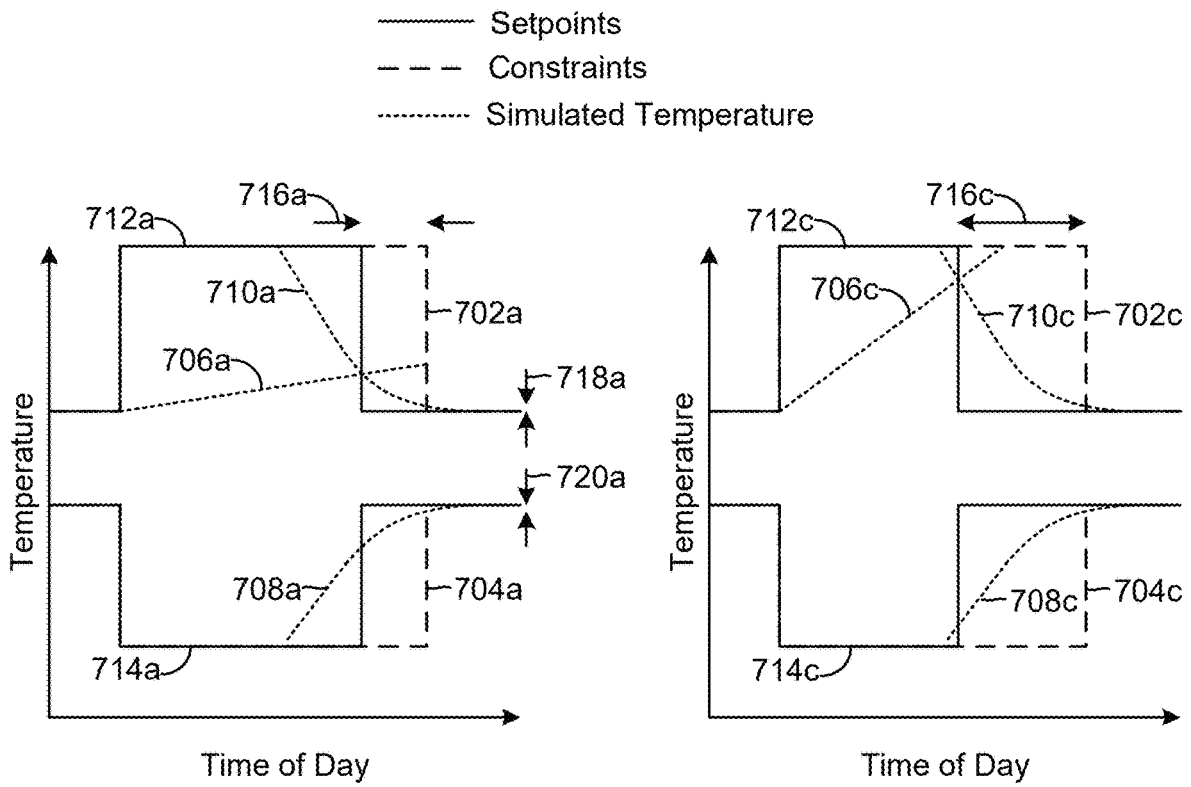
FIG. 8A
FIG. 8C
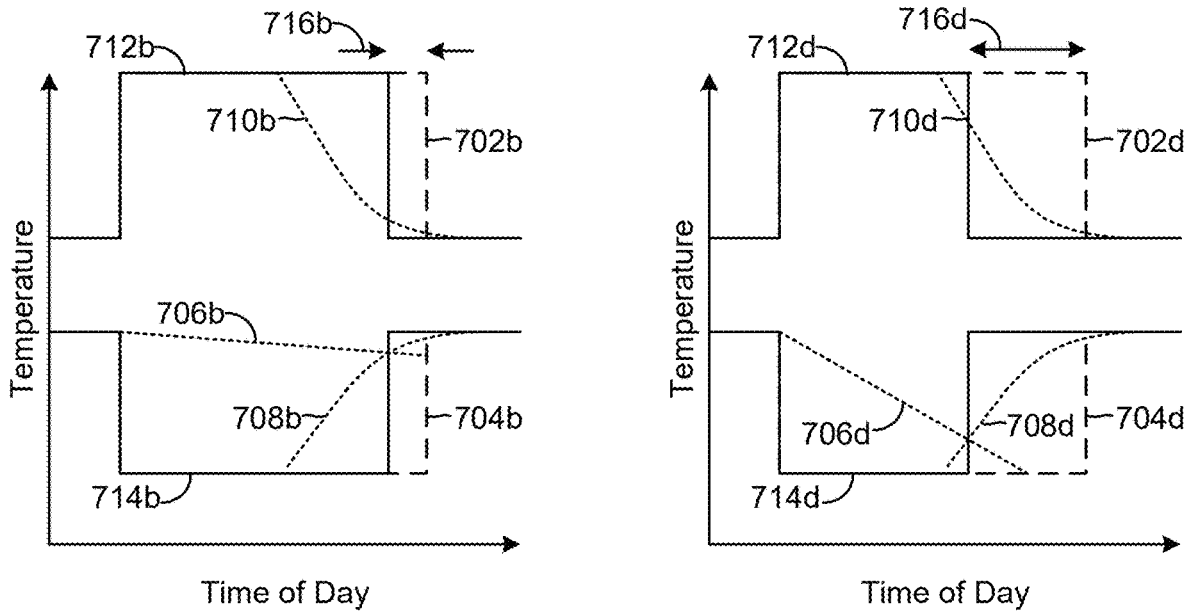
FIG. 8B
FIG. 8D

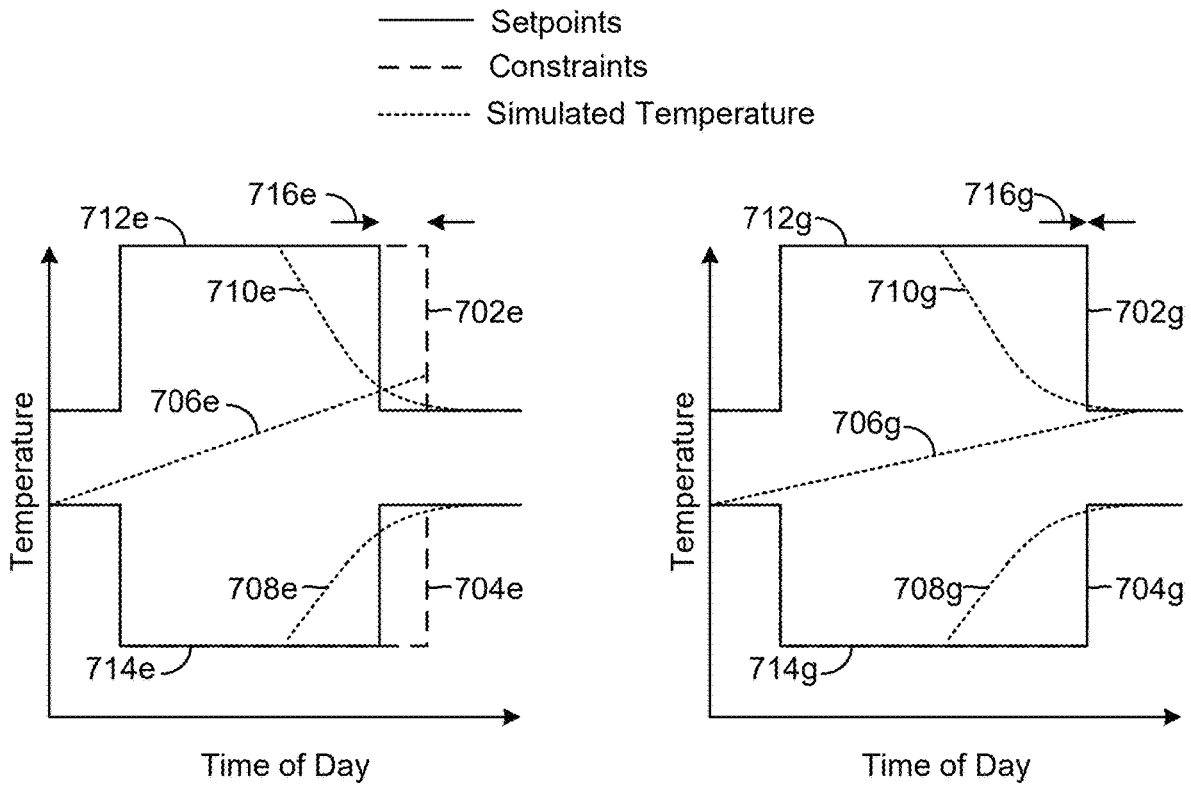
FIG. 8E
FIG. 8G
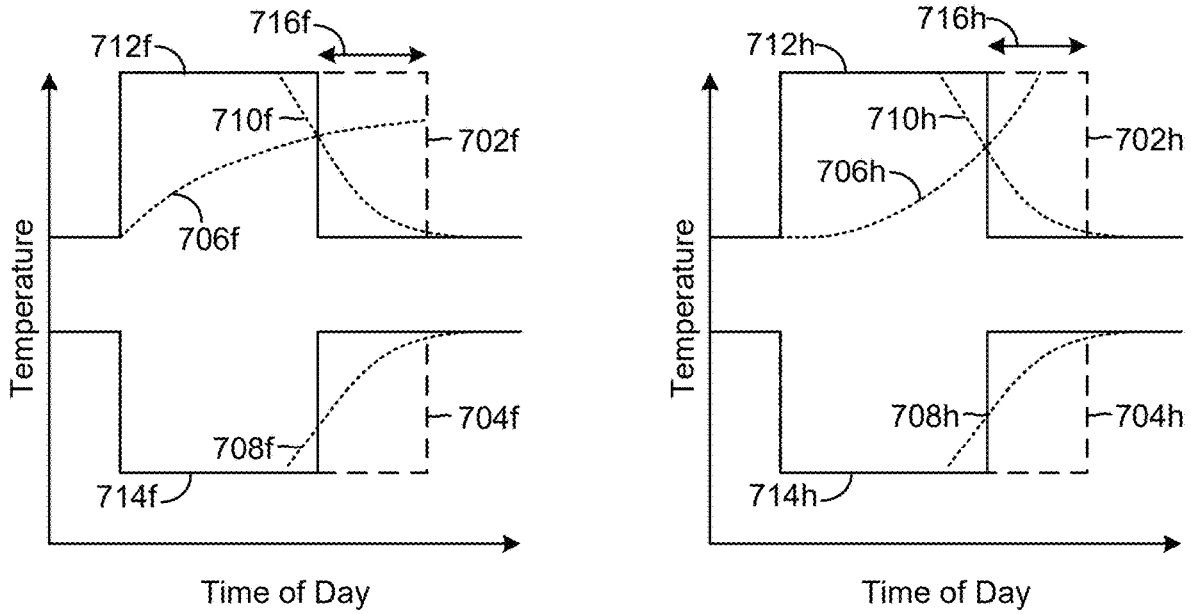
FIG. 8F
FIG. 8H

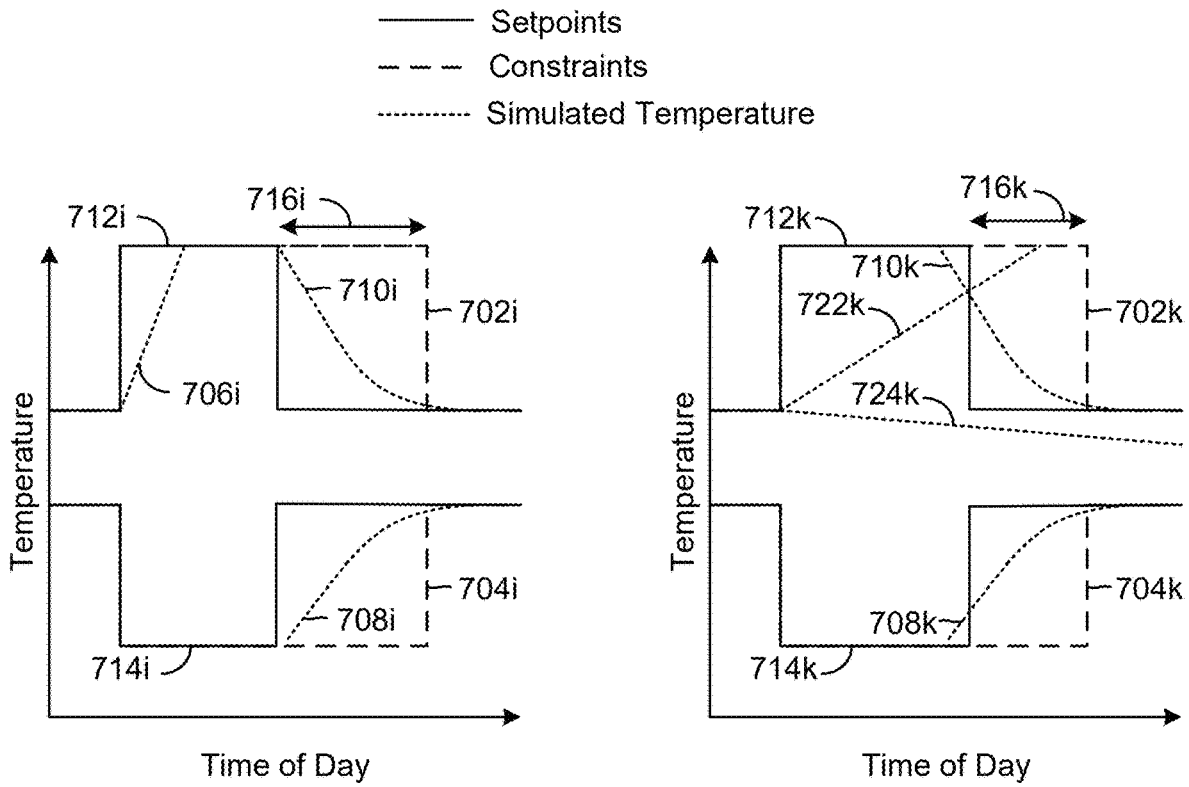
FIG. 8I
FIG. 8K
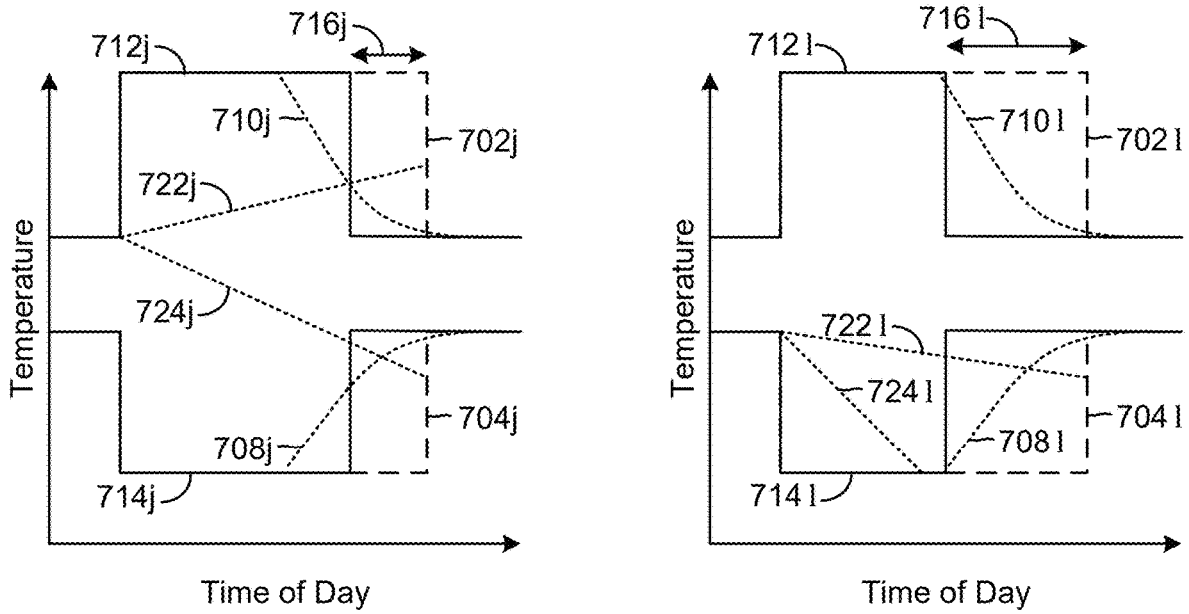
FIG. 8J
FIG. 8L

HVAC SYSTEMS WITH START TIME OPTIMIZATION

BACKGROUND

The present disclosure relates generally to controlling HVAC equipment. HVAC equipment is used to condition a space to be comfortable, healthy, and safe for occupants of an environment by using energy (e.g., electrical power or fuel). Reducing the energy consumption of HVAC equipment reduces the cost of energy incurred by building owners and reduces greenhouse gas emissions caused by operating the HVAC equipment. However, it can be challenging to determine a control strategy for HVAC equipment that reduces energy consumption while ensuring that the space is conditioned to acceptable limits for building occupants. The systems and methods described herein address this challenge and reduce the energy consumption and greenhouse gas emissions caused by operating HVAC equipment.

SUMMARY

At least one embodiment relates to a heating, ventilating, or air conditioning (HVAC) system that operates HVAC equipment to affect at least one physical property of an environment. The HVAC system includes one or more memory devices having instructions stored thereon that, when executed by one or more processors, cause the one or more processors to perform operations. The operations include obtaining a schedule for the environment. The schedule includes at least (i) a first time period and a third time period during which a criterion for the at least one physical property of the environment is to be satisfied and (ii) a second time period occurring between the first time period and the third time period and during which the criterion for the at least one physical property of the environment need not be satisfied. The operations also include predicting, using a first model, a first timeseries of the at least one physical property of the environment during the second time period, the first timeseries satisfying the criterion at a beginning of the third time period, wherein the first model describes behavior of the at least one physical property of the environment when the HVAC equipment is conditioning the environment in a first control mode. The operations also include predicting, using a second model, a second timeseries of the at least one physical property of the environment during the second time period, the second timeseries satisfying the criterion at an end of the first time period, wherein the second model describes the behavior of the at least one physical property of the environment when the HVAC equipment is in a second control mode. The operations also include determining, based on the first timeseries and the second timeseries, a transition time during the second time period at which to transition from operating the HVAC equipment in the second control mode to operating the HVAC equipment in the first control mode to cause the criterion to be satisfied at the beginning of the third time period. The operations also include operating the HVAC equipment in the first control mode during a terminal portion of the second time period beginning at the transition time.

In some embodiments, the first control mode includes controlling the at least one physical property towards a setpoint and the second control mode includes at least one of the equipment being off or the equipment not controlling the at least one physical property towards the setpoint.

In some embodiments, the at least one physical property includes at least one of a temperature, a humidity, or a carbon dioxide level and the environment is a space of a building.

In some embodiments, a form of the first model or the second model is chosen based on physical characteristics of the space.

In some embodiments, the environment was or is predicted to be occupied during the first time period and the third time period and the environment is predicted to be unoccupied during the third time period.

In some embodiments, the operations also include predicting a variable or condition of the building indicative of occupancy and using the prediction of the variable or condition of the building to determine times at which the environment is predicted to be occupied.

In some embodiments, the variable or condition of the building indicative of occupancy is a load for the HVAC equipment.

In some embodiments, the criterion is satisfied when the at least one physical property is within a range including a target value of the at least one physical property.

In some embodiments, determining the transition time during the second time period based on the first timeseries and the second timeseries includes determining a time at which the first timeseries and the second timeseries coincide.

In some embodiments, the operations also include determining parameters of the first model or the second model using at least one of using historical behavior of the environment, using a configuration of the building automation system, using a manufacturer specification of the equipment.

Another embodiment relates to a method for controlling HVAC equipment to affect at least one physical property of an environment. The method includes obtaining a schedule for the environment. The schedule includes at least (i) a first time period and a third time period during which a criterion for the at least one physical property of the environment is to be satisfied and (ii) a second time period occurring between the first time period and the third time period and during which the criterion for the at least one physical property of the environment need not be satisfied. The method also includes predicting, using a first model, a first timeseries of the at least one physical property of the environment during the second time, the first timeseries satisfying the criterion at a beginning of the third time period, wherein the first model describes behavior of the at least one physical property of the environment when the HVAC equipment is conditioning the environment in a first control mode. The method also includes predicting, using a second model, a second timeseries of the at least one physical property of the environment during the second time, the second timeseries satisfying the criterion at an end of the first time period, wherein the second model describes the behavior of the at least one physical property of the environment when the HVAC equipment is in a second control mode. The method also includes determining, based on the first timeseries and the second timeseries, a transition time during the second time period at which to transition from operating the HVAC equipment in the second control mode to operating the HVAC equipment in the first control mode to cause the criterion to be satisfied at the beginning of the third time period. The method also includes operating the HVAC equipment in the first control mode during a terminal portion of the second time period beginning at the transition time.

In some embodiments, the first control mode includes controlling the at least one physical property towards a setpoint and the second control mode includes at least one of the equipment being off or the equipment not controlling the at least one physical property towards the setpoint.

In some embodiments, the method also includes predicting a load for the HVAC equipment, using the prediction of the load or condition of the building to determine times at which the environment is predicted to be occupied, and determining the third time period based on the times at which the environment is predicted to be occupied.

In some embodiments, the criterion is satisfied when the at least one physical property is within a range including a target value of the at least one physical property.

In some embodiments, determining the transition time during the second time period based on the first timeseries and the second timeseries includes determining a time at which the first timeseries and the second timeseries coincide.

Another embodiment relates to a building automation system for scheduling a time equipment should condition an environment. The building automation system includes one or more memory devices having instructions stored thereon that, when executed by one or more processors, cause the one or more processors to perform operations. The operations include obtaining a first model describing behavior of at least one physical property of the environment when the equipment is conditioning the environment in a first control mode. The operations also include obtaining a second model describing behavior of the at least one physical property of the environment when the equipment is in a second control mode. The operations also include generating an optimization problem including at least a first constraint based on the behavior of the at least one physical property of the environment described by the first model or the second model, a second constraint based on a comfort criterion active during time periods for which the environment is scheduled to be occupied, wherein decision variables of the optimization problem include a first time the equipment is to condition the environment in the first control mode and a second time the equipment is to be in the second control mode. The operations also include calculating a solution to the optimization problem and operating the equipment in the first control mode during the first time in the solution and operating the equipment in the second control mode during the second time in the solution.

In some embodiments, the at least one physical property includes at least one of a temperature, a humidity, or a carbon dioxide level and the environment is a zone or a room of a building.

In some embodiments, a form of the first model or the second model is chosen based on physical characteristics of the zone or the room.

In some embodiments, the first control mode includes controlling the at least one physical property towards a setpoint and the second control mode includes at least one of the equipment being off or the equipment not controlling the at least one physical property towards the setpoint.

In some embodiments, an objective function of the optimization problem includes an amount of time the equipment is conditioning the environment in the first control mode.

This summary is illustrative only and not intended to be limiting.

BRIEF DESCRIPTION OF THE DRAWINGS

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

FIGS. 8A-8I are plots of setpoints, temperature constraints, and a simulated temperature illustrating a backward and forward simulation to find an optimal start time, according to some embodiments.

FIGS. 8J-8L are plots of setpoints, temperature constraints, backward simulated temperatures and upper and lower confidence bounds describing a forward stochastic simulation, according to some embodiments.

DETAILED DESCRIPTION

Overview

Referring generally to the FIGURES, systems and methods for optimally starting HVAC equipment are shown, according to various embodiments. When HVAC equipment is conditioning a space (e.g., providing heating, cooling, and/or ventilation) the HVAC system is using energy, thus it is advantageous to condition a space or environment with HVAC equipment for a minimal amount of time. When occupants are not in a space it may not be necessary to condition the space and temperatures can be setback resulting in energy savings. However, it takes some time for HVAC equipment to make a space comfortable for occupants if it has not been conditioning the space for some time.

Many building environments have variable occupancy schedules. Beginning heating and cooling as occupants enter the environment may result in discomfort for a period of time. In some cases the temperature may not become comfortable until the time the occupants are again (e.g., for a one hour class period or a short meeting), resulting in discomfort and less energy savings because the equipment was still run. As a result, it is important to determine when the HVAC system should begin conditioning the environment in anticipation of upcoming occupancy.

In some embodiments, the systems and methods of the present disclosure can perform various simulations to determine an optimal time to begin conditioning the space prior to occupancy and send commands to the HVAC equipment or their respective controllers. Thus, the space can be preemptively conditioned and is comfortable for occupants that arrive at the expected time. The calculations can be performed for one or more spaces (e.g., environments) grouped together or independently to find optimal start times for all the spaces in an area, building, and/campus. The calculations can be performed for several future unoccupied time periods to determine a future schedule of times the HVAC equipment is expected to run. The schedule can be provided to controllers for execution (e.g., in the event of a communication loss where start time optimization system can no longer send start commands). The schedule can also be communicated to other systems, for example, to aid in load prediction in a central plant optimization system or to an operator display. Advantageously, these features reduce the energy consumption of the HVAC equipment and the greenhouse gas emissions associated therewith.

Building HVAC System

Figure 1:
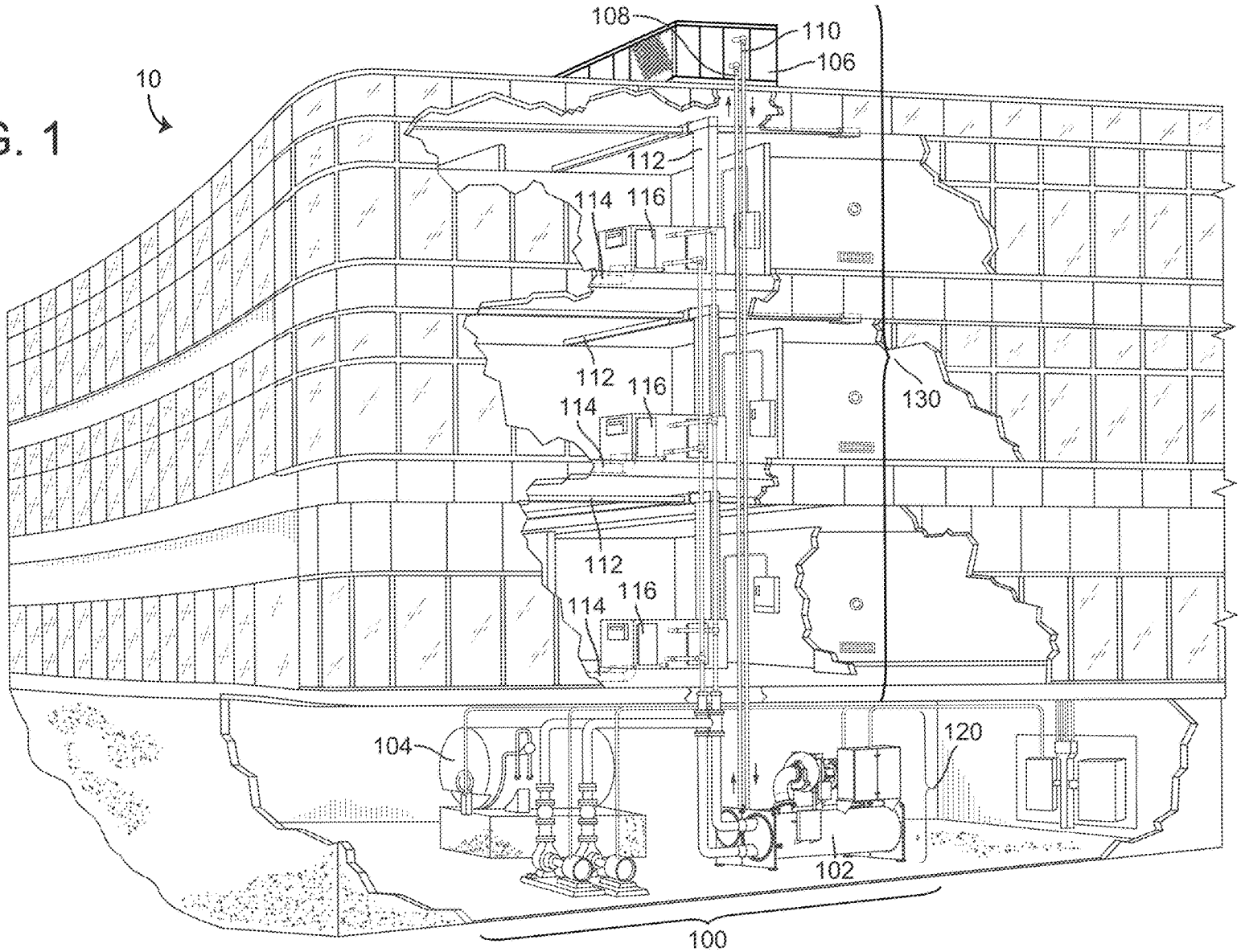
FIG. 1 is a perspective view of a building including a heating, ventilating, or air conditioning (HVAC) system, according to some embodiments.

Referring now to FIG. 1, a perspective view of a building 10 is shown. Building 10 is served by a heating, ventilating, or air conditioning (HVAC) system 100. HVAC system 100 can include a plurality of HVAC devices (e.g., heaters, chillers, air handling units, pumps, fans, thermal energy storage, etc.) configured to provide heating, cooling, air conditioning, ventilation, and/or other services for building 10. For example, HVAC system 100 is shown to include a waterside system 120 and an airside system 130. Waterside system 120 may provide a heated or chilled fluid to an air handling unit of airside system 130. Airside system 130 may use the heated or chilled fluid to heat or cool an airflow provided to building 10.

HVAC system 100 is shown to include a chiller 102, a boiler 104, and a rooftop air handling unit (AHU) 106. Waterside system 120 may use boiler 104 and chiller 102 to heat or cool a working fluid (e.g., water, glycol, etc.) and may circulate the working fluid to AHU 106. In various embodiments, the HVAC devices of waterside system 120 can be located in or around building 10 (as shown in FIG. 1) or at an offsite location such as a central plant (e.g., a chiller plant, a steam plant, a heat plant, etc.) that serves one or more buildings including building 10. The working fluid can be heated in boiler 104 or cooled in chiller 102, depending on whether heating or cooling is required in building 10. Boiler 104 may add heat to the circulated fluid, for example, by burning a combustible material (e.g., natural gas) or using an electric heating element. Chiller 102 may place the circulated fluid in a heat exchange relationship with another fluid (e.g., a refrigerant) in a heat exchanger (e.g., an evaporator) to absorb heat from the circulated fluid. The working fluid from chiller 102 and/or boiler 104 can be transported to AHU 106 via piping 108.

AHU 106 may place the working fluid in a heat exchange relationship with an airflow passing through AHU 106 (e.g., via one or more stages of cooling coils and/or heating coils). The airflow can be, for example, outside air, return air from within building 10, or a combination of both. AHU 106 may transfer heat between the airflow and the working fluid to provide heating or cooling for the airflow. For example, AHU 106 can include one or more fans or blowers configured to pass the airflow over or through a heat exchanger containing the working fluid. The working fluid may then return to chiller 102 or boiler 104 via piping 110.

Airside system 130 may deliver the airflow supplied by AHU 106 (i.e., the supply airflow) to building 10 via air supply ducts 112 and may provide return air from building 10 to AHU 106 via air return ducts 114. In some embodiments, airside system 130 includes multiple variable air volume (VAV) units 116. For example, airside system 130 is shown to include a separate VAV unit 116 on each floor or zone of building 10. VAV units 116 can include dampers or other flow control elements that can be operated to control an amount of the supply airflow provided to individual zones of building 10. In other embodiments, airside system 130 delivers the supply airflow into one or more zones of building 10 (e.g., via supply ducts 112) without using intermediate VAV units 116 or other flow control elements. AHU 106 can include various sensors (e.g., temperature sensors, pressure sensors, etc.) configured to measure attributes of the supply airflow. AHU 106 may receive input from sensors located within AHU 106 and/or within the building zone and may adjust the flow rate, temperature, or other attributes of the supply airflow through AHU 106 to achieve setpoint conditions for the building zone.

Airside System

Figure 2:
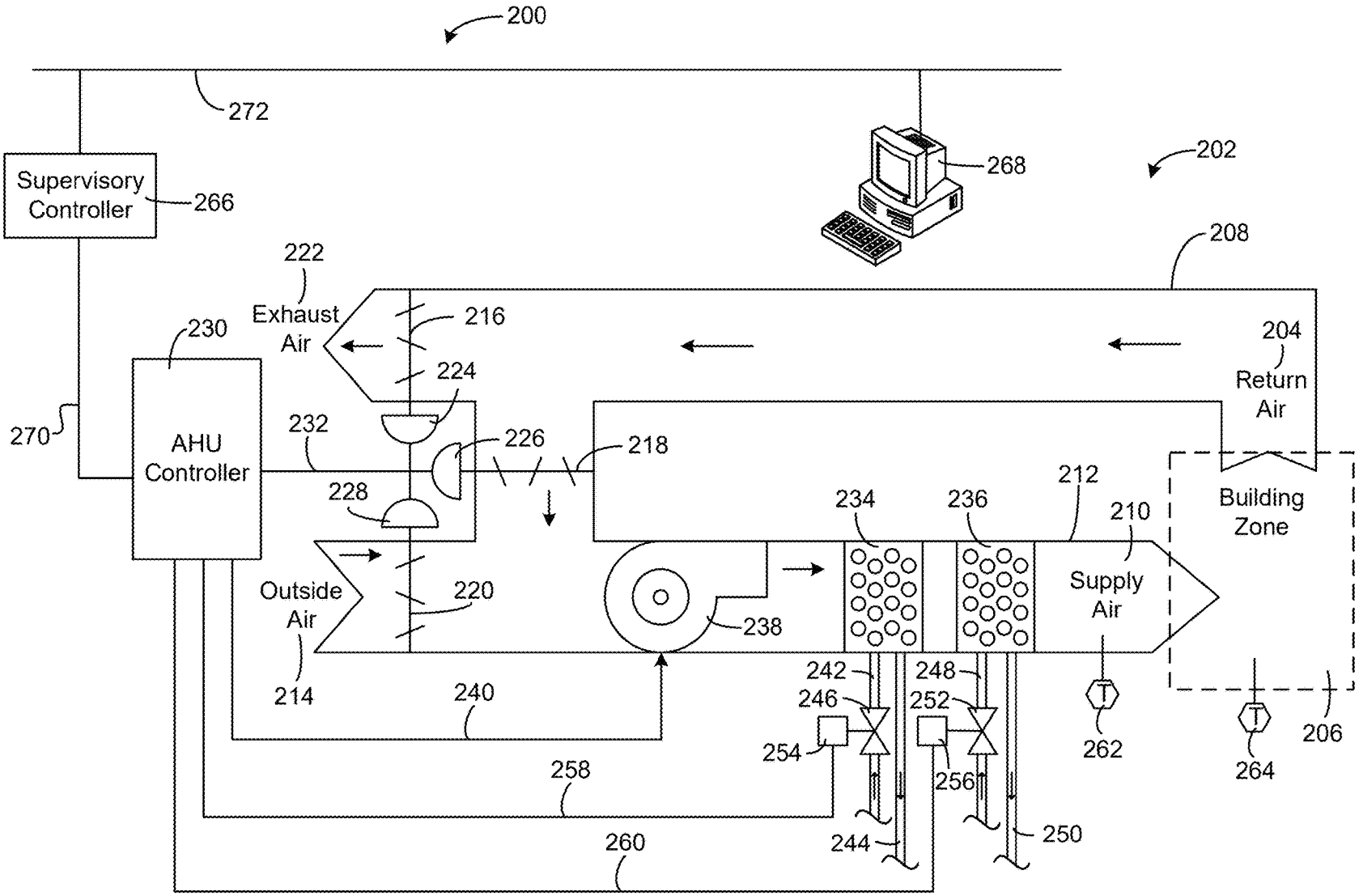
FIG. 2 is a block diagram of an airside system including an air handling unit (AHU) which can be used in the HVAC system of FIG. 1, according to some embodiments.

Referring now to FIG. 2, a block diagram of an airside system 200 is shown, according to some embodiments. In various embodiments, airside system 200 may supplement or replace airside system 130 in HVAC system 100 or can be implemented separate from HVAC system 100. When implemented in HVAC system 100, airside system 200 can include a subset of the HVAC devices in HVAC system 100 (e.g., AHU 106, VAV units 116, ducts 112-114, fans, dampers, etc.) and can be located in or around building 10. Airside system 200 may operate to heat or cool an airflow provided to building 10 using a heated or chilled fluid provided by waterside system 120.

In FIG. 2, airside system 200 is shown to include an economizer-type air handling unit (AHU) 202. Economizer-type AHUs vary the amount of outside air and return air used by the air handling unit for heating or cooling. For example, AHU 202 may receive return air 204 from building zone 206 via return air duct 208 and may deliver supply air 210 to building zone 206 via supply air duct 212. In some embodiments, AHU 202 is a rooftop unit located on the roof of building 10 (e.g., AHU 106 as shown in FIG. 1) or otherwise positioned to receive both return air 204 and outside air 214. AHU 202 can be configured to operate exhaust air damper 216, mixing damper 218, and outside air damper 220 to control an amount of outside air 214 and return air 204 that combine to form supply air 210. Any return air 204 that does not pass through mixing damper 218 can be exhausted from AHU 202 through exhaust damper 216 as exhaust air 222.

Each of dampers 216-220 can be operated by an actuator. For example, exhaust air damper 216 can be operated by actuator 224, mixing damper 218 can be operated by actuator 226, and outside air damper 220 can be operated by actuator 228. Actuators 224-228 may communicate with an AHU controller 230 via a communications link 232. Actuators 224-228 may receive control signals from AHU controller 230 and may provide feedback signals to AHU controller 230. Feedback signals can include, for example, an indication of a current actuator or damper position, an amount of torque or force exerted by the actuator, diagnostic information (e.g., results of diagnostic tests performed by actuators 224-228), status information, commissioning information, configuration settings, calibration data, and/or other types of information or data that can be collected, stored, or used by actuators 224-228. AHU controller 230 can be an economizer controller configured to use one or more control algorithms (e.g., state-based algorithms, extremum seeking control (ESC) algorithms, proportional-integral (PI) control algorithms, proportional-integral-derivative (PID) control algorithms, model predictive control (MPC) algorithms, feedback control algorithms, etc.) to control actuators 224-228.

Still referring to FIG. 2, AHU 202 is shown to include a cooling coil 234, a heating coil 236, and a fan 238 positioned within supply air duct 212. Fan 238 can be configured to force supply air 210 through cooling coil 234 and/or heating coil 236 and provide supply air 210 to building zone 206. AHU controller 230 may communicate with fan 238 via communications link 240 to control a flow rate of supply air 210. In some embodiments, AHU controller 230 controls an amount of heating or cooling applied to supply air 210 by modulating a speed of fan 238.

Cooling coil 234 may receive a chilled fluid from waterside system 120 (via piping 242 and may return the chilled fluid to waterside system 120 via piping 244. Valve 246 can be positioned along piping 242 or piping 244 to control a flow rate of the chilled fluid through cooling coil 234. In some embodiments, cooling coil 234 includes multiple stages of cooling coils that can be independently activated and deactivated (e.g., by AHU controller 230, by supervisory controller 266, etc.) to modulate an amount of cooling applied to supply air 210.

Heating coil 236 may receive a heated fluid from waterside system 120 via piping 248 and may return the heated fluid to waterside system 120 via piping 250. Valve 252 can be positioned along piping 248 or piping 250 to control a flow rate of the heated fluid through heating coil 236. In some embodiments, heating coil 236 includes multiple stages of heating coils that can be independently activated and deactivated (e.g., by AHU controller 230, by supervisory controller 266, etc.) to modulate an amount of heating applied to supply air 210.

Each of valves 246 and 252 can be controlled by an actuator. For example, valve 246 can be controlled by actuator 254 and valve 252 can be controlled by actuator 256. Actuators 254-256 may communicate with AHU controller 230 via communications links 258-260. Actuators 254-256 may receive control signals from AHU controller 230 and may provide feedback signals to controller 230. In some embodiments, AHU controller 230 receives a measurement of the supply air temperature from a temperature sensor 262 positioned in supply air duct 212 (e.g., downstream of cooling coil 234 and/or heating coil 236). AHU controller 230 may also receive a measurement of the temperature of building zone 206 from a temperature sensor 264 located in building zone 206.

In some embodiments, AHU controller 230 operates valves 246 and 252 via actuators 254-256 to modulate an amount of heating or cooling provided to supply air 210 (e.g., to achieve a setpoint temperature for supply air 210 or to maintain the temperature of supply air 210 within a setpoint temperature range). The positions of valves 246 and 252 affect the amount of heating or cooling provided to supply air 210 by cooling coil 234 or heating coil 236 and may correlate with the amount of energy consumed to achieve a desired supply air temperature. AHU controller 230 may control the temperature of supply air 210 and/or building zone 206 by activating or deactivating coils 234-236, adjusting a speed of fan 238, or a combination of both.

Still referring to FIG. 2, airside system 200 is shown to include a supervisory controller 266 and a client device 268. Supervisory controller 266 can include one or more computer systems (e.g., servers, supervisory controllers, subsystem controllers, etc.) that serve as system level controllers, application or data servers, head nodes, or master controllers for airside system 200, waterside system 120, HVAC system 100, and/or other controllable systems that serve building 10. Supervisory controller 266 may communicate with multiple downstream building systems or subsystems (e.g., HVAC system 100, a security system, a lighting system, waterside system 120, etc.) via a communications link 270 according to like or disparate protocols (e.g., LON, BACnet, etc.). In various embodiments, AHU controller 230 and supervisory controller 266 can be separate (as shown in FIG. 2) or integrated. In an integrated implementation, AHU controller 230 can be a software module configured for execution by a processor of supervisory controller 266.

In some embodiments, AHU controller 230 receives information from supervisory controller 266 (e.g., commands, setpoints, operating boundaries, etc.) and provides information to supervisory controller 266 (e.g., temperature measurements, valve or actuator positions, operating statuses, diagnostics, etc.). For example, AHU controller 230 may provide supervisory controller 266 with temperature measurements from temperature sensors 262-264, equipment on/off states, equipment operating capacities, and/or any other information that can be used by supervisory controller 266 to monitor or control a variable state or condition within building zone 206.

Client device 268 can include one or more human-machine interfaces or client interfaces (e.g., graphical user interfaces, reporting interfaces, text-based computer interfaces, client-facing web services, web servers that provide pages to web clients, etc.) for controlling, viewing, or otherwise interacting with HVAC system 100, its subsystems, and/or devices. Client device 268 can be a computer workstation, a client terminal, a remote or local interface, or any other type of user interface device. Client device 268 can be a stationary terminal or a mobile device. For example, client device 268 can be a desktop computer, a computer server with a user interface, a laptop computer, a tablet, a smartphone, a PDA, or any other type of mobile or non-mobile device. Client device 268 may communicate with supervisory controller 266 and/or AHU controller 230 via communications link 272.

AHU Controller

Figure 3:
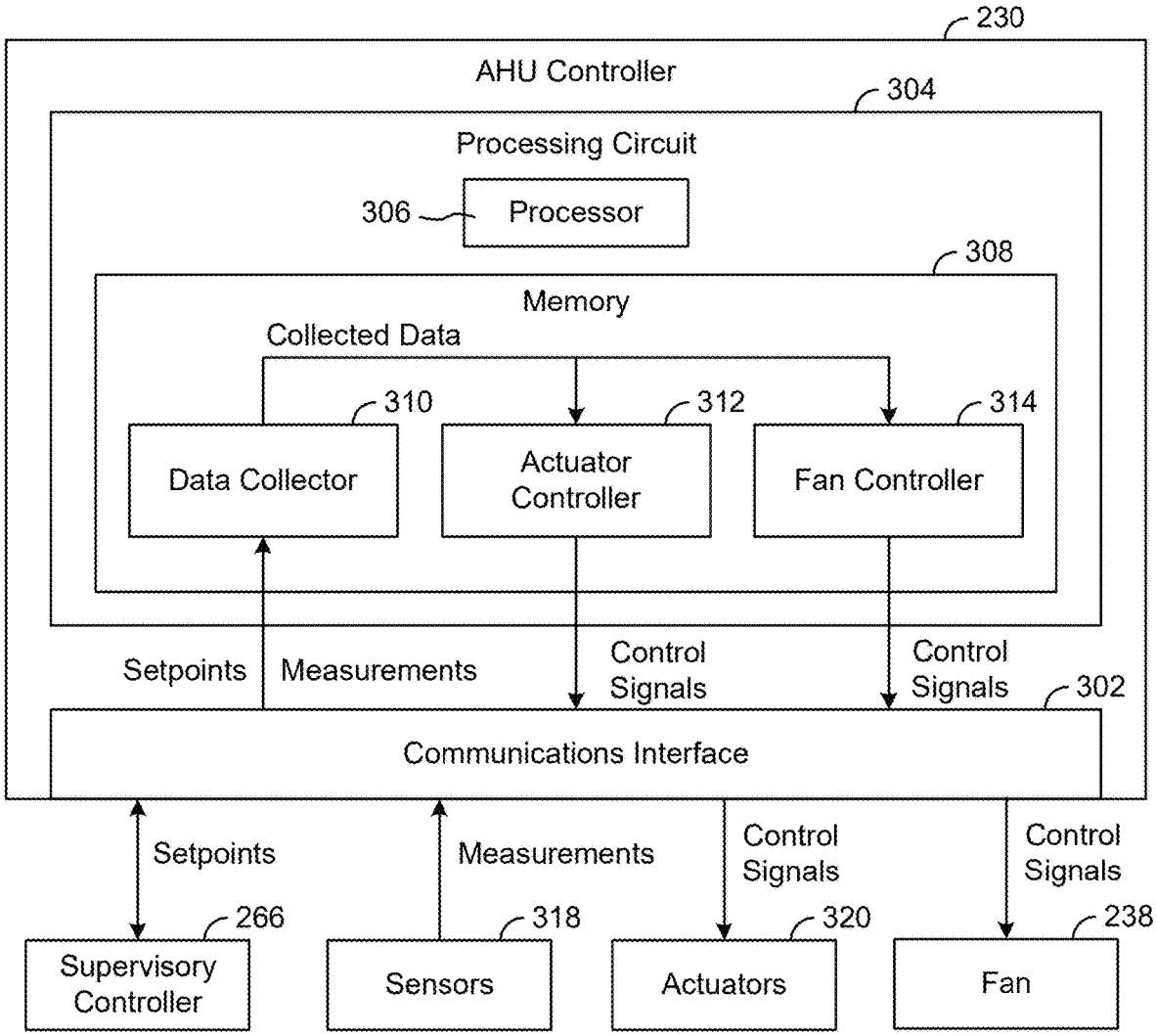
FIG. 3 is a block diagram of an AHU controller which can be used to monitor and control the AHU of FIG. 2, according to some embodiments.

Referring now to FIG. 3, a block diagram illustrating AHU controller 230 in greater detail is shown, according to an exemplary embodiment. AHU controller 230 may be configured to monitor and control various components of AHU 202 using any of a variety of control techniques (e.g., state-based control, on/off control, proportional control, proportional-integral (PI) control, proportional-integral-derivative (PID) control, extremum seeking control (ESC), model predictive control (MPC), etc.). AHU controller 230 may receive setpoints from supervisory controller 266 and measurements from sensors 318 and may provide control signals to actuators 320 and fan 238.

Sensors 318 may include any of the sensors shown in FIG. 2 or any other sensor configured to monitor any of a variety of variables used by AHU controller 230. Variables monitored by sensors 318 may include, for example, zone air temperature, zone air humidity, zone occupancy, zone CO2 levels, zone particulate matter (PM) levels, outdoor air temperature, outdoor air humidity, outdoor air CO2 levels, outdoor air PM levels, damper positions, valve positions, fan status, supply air temperature, supply air flowrate, or any other variable of interest to AHU controller 230.

Actuators 320 may include any of the actuators shown in FIG. 2 or any other actuator controllable by AHU controller 230. For example, actuators 320 may include actuator 224 configured to operate exhaust air damper 216, actuator 226 configured to operate mixing damper 218, actuator 228 configured to outside air damper 220, actuator 254 configured to operate valve 246, and actuator 256 configured to operate valve 252. Actuators 320 may receive control signals from AHU controller 230 and may provide feedback signals to AHU controller 230.

AHU controller 230 may control AHU 202 by controllably changing and outputting a control signals provided to actuators 320 and fan 238. In some embodiments, the control signals include commands for actuators 320 to set dampers 216-220 and/or valves 246 and 252 to specific positions to achieve a target value for a variable of interest (e.g., supply air temperature, supply air humidity, flow rate, etc.). In some embodiments, the control signals include commands for fan 238 to operate a specific operating speed or to achieve a specific airflow rate. The control signals may be provided to actuators 320 and fan 238 via communications interface 302. AHU 202 may use the control signals an input to adjust the positions of dampers 216-220 control the relative proportions of outside air 214 and return air 204 provided to building zone 206.

AHU controller 230 may receive various inputs via communications interface 302. Inputs received by AHU controller 230 may include setpoints from supervisory controller 266, measurements from sensors 318, a measured or observed position of dampers 216-220 or valves 246 and 252, a measured or calculated amount of power consumption, an observed fan speed, temperature, humidity, air quality, or any other variable that can be measured or calculated in or around building 10.

AHU controller 230 includes logic that adjusts the control signals to achieve a target outcome. In some operating modes, the control logic implemented by AHU controller 230 utilizes feedback of an output variable. The logic implemented by AHU controller 230 may also or alternatively vary a manipulated variable based on a received input signal (e.g., a setpoint). Such a setpoint may be received from a user control (e.g., a thermostat), a supervisory controller (e.g., supervisory controller 266), or another upstream device via a communications network (e.g., a BACnet network, a LonWorks network, a LAN, a WAN, the Internet, a cellular network, etc.).

Still referring to FIG. 3, AHU controller 230 is shown to include a communications interface 302. Communications interface 302 can be or include wired or wireless communications interfaces (e.g., jacks, antennas, transmitters, receivers, transceivers, wire terminals, etc.) for conducting data communications with various components of AHU 202 or other external systems or devices. In various embodiments, communications via communications interface 302 can be direct (e.g., local wired or wireless communications) or via a communications network (e.g., a WAN, the Internet, a cellular network, etc.). For example, communications interface 302 can include an Ethernet card and port for sending and receiving data via an Ethernet-based communications link or network. In another example, communications interface 302 can include a Wi-Fi transceiver for communicating via a wireless communications network. In another example, communications interface 302 can include a cellular or mobile phone transceiver, a power line communications interface, an Ethernet interface, or any other type of communications interface.

Still referring to FIG. 3, AHU controller 230 is shown to include a processing circuit 304 having a processor 306 and memory 308. Processor 306 may be a general purpose or specific purpose processor, an application specific integrated circuit (ASIC), one or more field programmable gate arrays (FPGAs), a group of processing components, or other suitable processing components. Processor 306 is configured to execute computer code or instructions stored in memory 308 or received from other computer readable media (e.g., CDROM, network storage, a remote server, etc.).

Memory 308 may include one or more devices (e.g., memory units, memory devices, storage devices, etc.) for storing data and/or computer code for completing and/or facilitating the various processes described in the present disclosure. Memory 308 may include random access memory (RAM), read-only memory (ROM), hard drive storage, temporary storage, non-volatile memory, flash memory, optical memory, or any other suitable memory for storing software objects and/or computer instructions. Memory 308 may include database components, object code components, script components, or any other type of information structure for supporting the various activities and information structures described in the present disclosure. Memory 308 may be communicably connected to processor 306 via processing circuit 304 and may include computer code for executing (e.g., by processor 306) one or more processes described herein.

Memory 308 can include any of a variety of functional components (e.g., stored instructions or programs) that provide AHU controller 230 with the ability to monitor and control AHU 202. For example, memory 308 is shown to include a data collector 310 which operates to collect the data received via communications interface 302 (e.g., setpoints, measurements, feedback from actuators 320 and fan 238, etc.). Data collector 310 may provide the collected data to actuator controller 312 and fan controller 314 which use the collected data to generate control signals for actuators 320 and fan 238, respectively. The particular type of control methodology used by actuator controller 312 and fan controller 314 (e.g., state-based control, PI control, PID control, ESC, MPC, etc.) may vary depending on the configuration of AHU controller and can be adapted for various implementations.

HVAC Systems with Start Time Optimization

Figure 4:
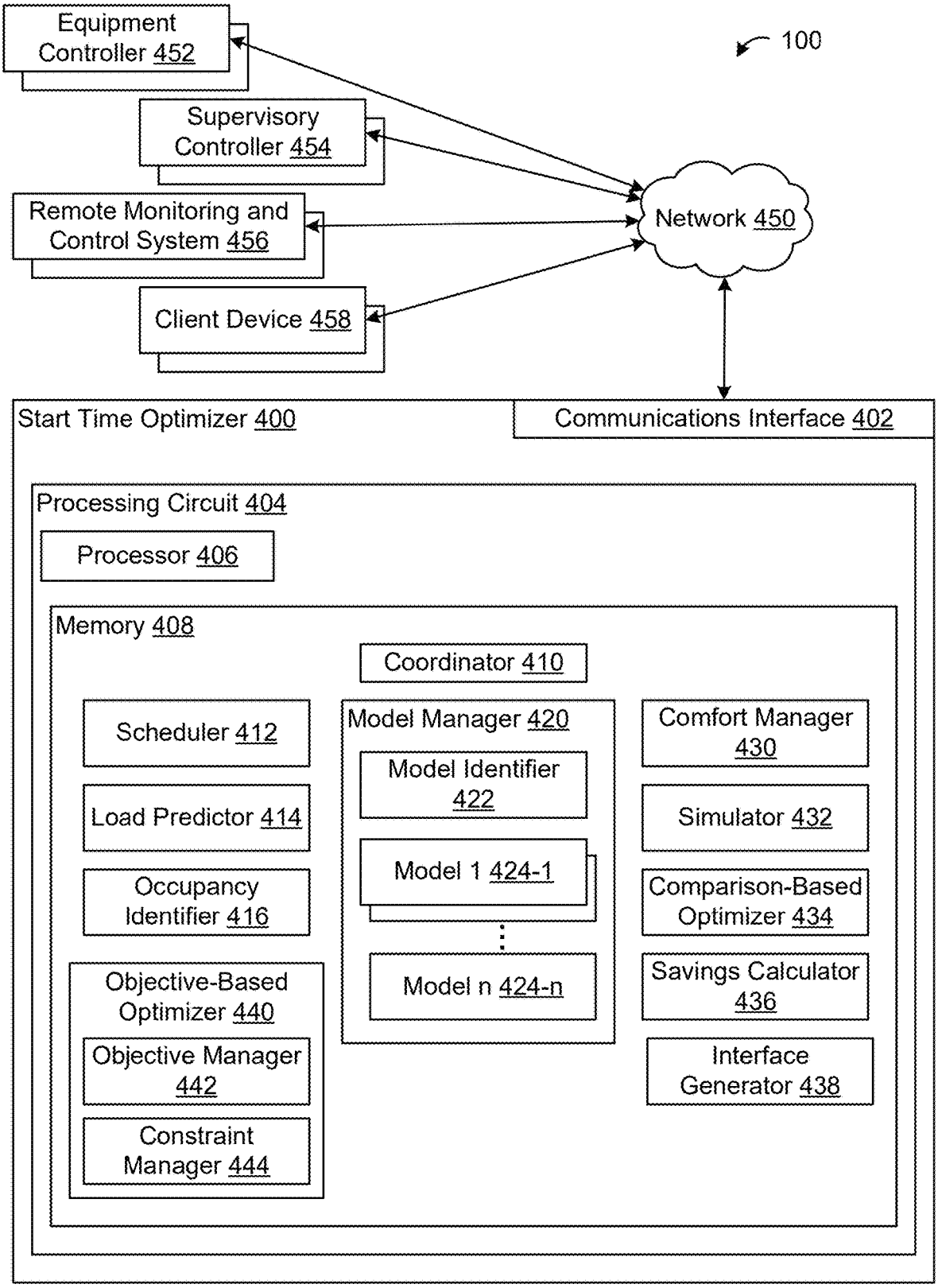
FIG. 4 is a schematic block diagram of a system for optimizing the start time of HVAC equipment, according to some embodiments.

FIG. 4, shows a schematic block diagram of HVAC system 100 according to some embodiments. HVAC system 100 is shown to include a start time optimizer 400 for determining a time to begin conditioning a building space (e.g., zone, room, environment, etc.). In some embodiments, the equipment conditioning the space is an air handler unit (AHU) as described in the previous sections. The example of an AHU system described should not be considered limiting. In some embodiments, a roof top unit (RTU), fan coil (FC), or any other equipment, device, or other system may be used to condition the space (e.g., to affect a variable or condition of the space to maintain comfort, safety, and/or health of an occupant or future occupant).

Energy (e.g., electrical energy, fuel resources, etc.) may be saved by choosing to run the HVAC system only when necessary. The start time optimizer 400 may determine when certain criteria need to be satisfied and run the HVAC system only to satisfy the criteria at the specified times. Nonlimiting examples of criteria that may be evaluated and maintained by start time optimizer 400 include a temperature within comfort bounds, CO2 below a threshold, ventilation above a threshold, humidity within comfort bounds, any other criterion that maintains occupant safety, health, and comfort of an occupant or future occupant, and/or combination thereof) For example, the start time optimizer 400 may be configured to predict occupancy and produce a schedule indicating when the HVAC system must run in order to satisfy a temperature criterion during occupied time periods. The start time optimizer 400 may also be configured to allow the HVAC system to be off (e.g., unit not using energy, not conditioning the space, not affecting a physical property of the environment, etc.) during time periods when the criteria do not need to be satisfied (e.g., during unoccupied time periods). At the beginning of the occupied time periods the start time optimizer 400 may send signals to the HVAC equipment and/or a controller of the HVAC equipment indicating that it is time to begin conditioning the space. The control signals may include a start command, a temperature setpoint, or any other command that may be used to initialize building control.

In some embodiments, the start time optimizer 400 may be implemented as part of the AHU controller 230 or another equipment controller 452. In some embodiments, the start time optimizer 400 may be implemented as part of a supervisory controller (e.g., supervisory controller 266 or 454). The start time optimizer 400 may be implemented in any computer hardware. For example, the start time optimizer 400 may be implemented in an edge device (e.g., any of the local control devices that are used to maintain comfort within an environment or the start time optimizer 400 may be implemented in a network architecture (e.g., on a node in a cloud architecture). In some embodiments, the start time optimizer 400 may be distributed across multiple computer hardware devices. The start time optimizer 400 may be distributed across multiple local controllers, networked computers, or any combination of the two.

During the time period when the certain criteria need to be satisfied the HVAC system 100 may continue to control variables or conditions of a space (e.g., zone, room, environment, etc.). In some embodiments, the computer hardware on which the start time optimizer 400 is disposed is responsible for both determining when the equipment should actively control the variable or condition of the space and for performing the actual control of the variable condition or space. For example, the controller may determine when active control is required and determine control signals to send to the actuators (e.g., valves, valve motors, dampers, damper motors, fan enables, fan variable speed drives, etc.) of the HVAC equipment. The computer hardware may send control signals including positions, percent openings, speeds, and/or any other type of control signal that may be used to affect a variable or condition of the space. In some embodiments, control is split between multiple computer hardware, devices, and/or controllers (e.g., similar to the controller 230). A first controller, including the start time optimizer 400, generates an on/off control signal or active/inactive control signal and communicates the information to another controller. The first controller, including the start time optimizer 400, may indirectly affect the variable or condition of the space by initiating control of the space.

The HVAC system 100 may also include additional equipment controllers 452 for example, to control various aspects of the HVAC system 100. The additional equipment controllers 452 may include one or more AHU controllers (e.g., similar to AHU controller 230), controllers for fan coils, controllers for variable refrigerant flow (VRF) devices, controllers for chillers, and/or controllers for any other equipment configured to affect variables or conditions of the space to maintain occupant comfort. The additional equipment controllers 452 may be configured to receive a control signal generated by the start time optimizer 400 that indicates the HVAC equipment should begin active control mode. In some embodiments, the additional equipment controllers 452 may be configured to receive a schedule of when the equipment the HVAC equipment should begin active control mode. For example, the start time optimizer 400 may be configured to periodically (e.g., every 15 minutes, each day, etc.) or aperiodically (e.g., on request, intermittently, or upon a trigger condition being satisfied such as when there is a significant change in the system or building environment) send the start/stop or active/inactive schedule. Advantageously, if the start time optimizer 400 loses its connection to the equipment controllers 452, a previously determined schedule can still be implemented by the equipment controllers 452. In some embodiments, one of the equipment controllers 452 of the HVAC system is configured to implement the start time optimizer 400.

The HVAC system 100 may also include additional supervisory controllers 454 for example, to control various aspects of the HVAC system 100. The supervisory controllers 454 may be configured with many of the same features as the additional equipment controllers 452. For example, the additional supervisory controllers 454 may configured to control AHUs, fan coils, chillers, etc. and/or relay messages from one controller to another. For example, the supervisory controller may include routing capability to provide communications on more than one network (e.g., network 450 and/or a local controller network such as a field controller bus). The supervisory controllers 454 may also have more computational capability than the equipment controllers 452. In some embodiments, one of the supervisory controllers 454 of the HVAC system is configured to implement the start time optimizer 400.

Figure 5A:
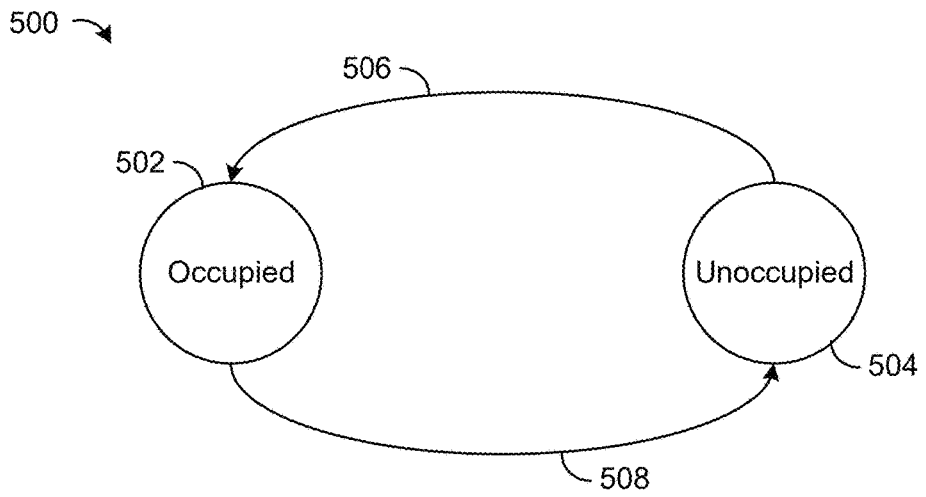
FIG. 5A is a state machine for HVAC equipment, according to some embodiments.

FIG. 5A shows environment control state machine 500 that may be implemented by the equipment controllers 452 according to some embodiments. The environment control state machine 500 is shown to include an occupied state 502 and an unoccupied state 504. During the occupied state 502, a controller implementing the environment control state machine 500 may control an environmental condition to a setpoint or within a range (e.g., a comfort band). During the occupied state 502, the controller may maintain temperature within comfort bounds, CO2 below a threshold, ventilation above a threshold, humidity within comfort bounds, any other criterion that maintains occupant safety, health, and comfort of an occupant or future occupant, and/or combination thereof). For example, the controller may send control signals including positions, percent openings, speeds, and/or any other type of control signal that may be used to an actuator of the HVAC equipment within HVAC system 100 to affect a variable or condition of the environment (e.g., space, zone, room, etc.). The controller may also monitor for conditions that would trigger a transition 508 to the unoccupied state 504. For example, the controller may monitor occupancy sensors, load on the HVAC equipment, time of day (e.g., relative to an occupancy schedule), signal from another controller (e.g., start time optimizer 400) etc. to determine if the state machine should transition to an unoccupied state 504.

During the unoccupied state 504, the controller may not control the environmental condition. For example, when the environmental control state machine 500 is in the unoccupied state 504 the controller may be configured allow the condition to evolve based on natural driving factors (e.g., the weather, human loads, etc.), but not use any mechanical (e.g., powered, electrical, etc.) method for controlling the condition. Additionally or alternatively, the controller may control to a relaxed setpoint (e.g., one requiring less energy use). During the unoccupied state 504, the controller may also monitor for conditions that would trigger a transition 506 to the occupied state 502. For example, the controller may monitor occupancy sensors, load on the HVAC equipment, time of day (e.g., relative to an occupancy schedule), signal from another controller (e.g., start time optimizer 400) etc. to determine if the state machine should transition to the occupied state 502.

Referring back to FIG. 4, the HVAC system 100 may include one or more remote monitoring and control systems 456. Remote monitoring and control systems 456 may be cloud implemented monitoring and/or control systems that use the schedules (e.g., active and inactive time periods) provided by the start time optimizer 400. For example, the start time optimizer 400 may be configured to provide start and stop times to a device optimization algorithm configured to determine the equipment that should be running (e.g., device selections) currently and in the future.

In some embodiments, the remote monitoring and control systems 456 may also provide (e.g., send, communicate, etc.) information from the start time optimizer 400. The start time optimizer 400 may use data-driven models (e.g., regression models, machine learning models, neural networks, etc.) to determine (e.g., train, fit, identify, etc.) the models that can predict environment behavior and be used to perform start time optimization. For example, the remote monitoring and control systems 456 may provide temperature information, weather forecasts, current load conditions, etc. to be used to predict the future loads, temperatures, etc.

The remote monitoring and control systems 456 may also provide instructions for a user interface to view the schedule determined by the start time optimizer 400 and supporting information used to determine the times to provide clear reasoning to operators that may be responsible in part for implementing the recommendations of the start time optimizer 400. The remote monitoring and control systems 456 can provide instructions to a client device 458 (e.g. JavaScript, Cascade Style Sheets) that instruct the client device 458 how to generate the user interface within a client application (e.g., an internet browser, a proprietary application, etc.) to show the schedules provided by the start time optimizer 400. The remote monitoring and control system 456 may also provide instructions for displaying other information for the user. For example, the remote monitoring and control system 456 may provide instructions for displaying environmental variables and/or conditions of the variable space affected by the HVAC equipment and the control processes described herein.

The HVAC system 100 may include the client device 458. The client device 458 may be any device capable of displaying information communicated over the network 450. For example, the client device may be a desktop computer, laptop computer, smartphone, tablet, etc. In some embodiments, the client device 458 may also receive user interface instructions from the start time optimizer 400 including instructions for API that can be used to configure the start time optimizer 400 and/or obtain information (e.g., schedules, variable predictions, etc.) from the start time optimizer 400.

According to some embodiments, the start time optimizer 400 includes a communications interface 402 and a processing circuit 404. The communications interface 402 is configured to facilitate communication between the start time optimizer 400 and the other devices, controllers, and systems of the HVAC system 100. The processing circuit 404 includes one or more processors 406 configured to execute instructions stored on memory 408.

The one or more processors 406 may be a general purpose or specific purpose processors, an application specific integrated circuit (ASIC), one or more field programmable gate arrays (FPGAs), a group of processing components, or other suitable processing components. The one or more processors 406 may be configured to execute computer code and/or instructions stored in the memories or received from other computer readable media (e.g., CDROM, network storage, a remote server, etc.). The one or more processors 406 may be configured in various computer architectures, such as graphics processing units (GPUs), distributed computing architectures, cloud server architectures, client-server architectures, or various combinations thereof. One or more first processors can be implemented by a first device, such as an edge device, and one or more second processors can be implemented by a second device, such as a server or other device that is communicatively coupled with the first device and may have greater processor and/or memory resources.

The memory 408 may include one or more devices (e.g., memory units, memory devices, storage devices, etc.) for storing data and/or computer code for completing and/or facilitating the various processes described in the present disclosure. The memory 408 may include random access memory (RAM), read-only memory (ROM), hard drive storage, temporary storage, non-volatile memory, flash memory, optical memory, or any other suitable memory for storing software objects and/or computer instructions. The memory 408 may include database components, object code components, script components, or any other type of information structure for supporting the various activities and information structures described in the present disclosure. The memory 408 may be communicably connected to the processors and can include computer code for executing (e.g., by the processors) one or more processes described herein.

In some embodiments, the start time optimizer 400 includes a coordinator 410. The coordinator 410 may be configured to control the timing and flow of data through the other instruction sets of start time optimizer. For example, the coordinator 410 may cause the instruction sets or circuits to execute in a specific order to perform the function of the start time optimizer 400. In some embodiments, the coordinator 410 may route the information and/or outputs of other modules that are dependent on the information or use the information as an input.

Figure 5B:
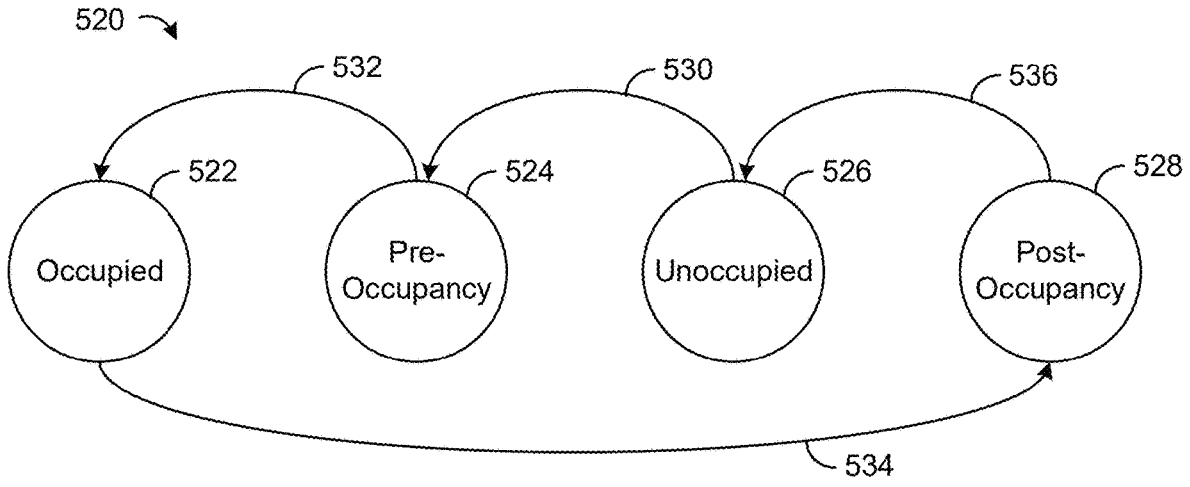
FIG. 5B is a state machine for the start time optimizer of FIG. 4, according to some embodiments.

FIG. 5B shows optimizer state machine 520 for coordinating the calculation of the optimal start time, according to some embodiments. The optimizer state machine 520 may, for example, be implemented by coordinator 410. It is contemplated that the configuration of the state machine 520 may depend on the output of the start time optimizer 400. For example, if the start time optimizer 400 outputs a binary output (e.g., active/inactive controller, HVAC system on/off, occupied/unoccupied, etc.) the state machine 520 may have fewer states or perform different actions within a given state.

The state machine 520 is shown to have an occupied state 522, a pre-occupancy state 524, an unoccupied state 526, and a post-occupancy state 528. During the occupied state 522 the coordinator 410 may cause the start time optimizer 400 to output an occupied temperature setpoint (e.g., 70° F.) for the equipment controller 542 (e.g., an additional equipment controller or the controller implementing start time optimizer 400). Alternatively or additionally, the start time optimizer may output an binary value indicating if the controller should be in active control. The start time optimizer 400 may also perform calculations to determine if a transition 534 should be taken to the post-occupancy state 528. For example, the start time optimizer may monitor occupancy sensors, load on the HVAC equipment, time of day (e.g., relative to an occupancy schedule), or signal from another controller (e.g., start time optimizer 400) etc. to determine if the state machine should transition to an unoccupied state the post occupancy state 528. In some embodiments, the start time optimizer 400 can predict the condition of the environment (e.g., using a simulator 432) if it were no longer conditioned (e.g., predict the temperature if no heat were added and or rejected). The start time optimizer 400 may determine to stop conditioning the zone early if it is predicted that the temperature will still be within a comfort band when the environment is no longer occupied.

During the post-occupied state 522 the coordinator 410 may cause the start time optimizer 400 to output an unoccupied temperature setpoint (e.g., 64° F.) for the equipment controller 542 (e.g., an additional equipment controller or the controller implementing start time optimizer 400). Alternatively or additionally, the start time optimizer 400 may output an binary value indicating if the controller should no longer be in active control. In some embodiments, the post-occupied state 528 is used when the environment is still occupied, but the start time optimizer 400 has determined that it will be unoccupied soon. For example, the post-occupancy state 528 may be active during a time when the ventilation is still required due to fresh air requirements (e.g., a health and safety concern), but the start time optimizer 400 has determined that heating/cooling is no longer needed based on the temperature prediction. In some embodiments, the post-occupancy state 528 may represent a time period during which the occupancy detection of the environment (e.g., performed by start time optimizer 400, equipment controller 452, supervisory controller 454, and/or remote monitoring and control system 456) is more sensitive, representing an increased likelihood that the environment becomes occupied again, shortly after becoming unoccupied.

The start time optimizer 400 may also perform calculations to determine if a transition 536 should be taken to the unoccupied state 526. For example, the start time optimizer may monitor occupancy sensors, load on the HVAC equipment, time of day (e.g., relative to an occupancy schedule), or signal from another controller (e.g., start time optimizer 400) or a certain amount of time has passed since entering the post-occupancy state 528 etc. to determine if the state machine should transition to the unoccupied state 526.

During the unoccupied state 526 the coordinator 410 may cause the start time optimizer 400 to output an unoccupied temperature setpoint (e.g., 64° F.) for the equipment controller 542 (e.g., an additional equipment controller or the controller implementing start time optimizer 400). Alternatively or additionally, the start time optimizer 400 may output an binary value indicating if the controller should no longer be in active control. The start time optimizer 400 may also perform calculations to determine if a transition 530 should be taken to the pre-occupancy state 524. The start time optimizer may monitor occupancy sensors, load on the HVAC equipment, time of day (e.g., relative to an occupancy schedule), or signal from another controller (e.g., start time optimizer 400) etc. to determine if the state machine should transition to the pre-occupancy state 528. For example, the start time optimizer 400 may predict the temperature if the controller entered an active control mode and determine the time at which the controller must begin active control in order to reach a comfort band within at the same time the environment becomes occupied.

During the pre-occupancy state 524 the coordinator 410 may cause the start time optimizer 400 to output an occupied temperature setpoint (e.g., 70° F.) for the equipment controller 542 (e.g., an additional equipment controller or the controller implementing start time optimizer 400). Alternatively or additionally, the start time optimizer 400 may output an binary value indicating if the controller should be in active control. In some embodiments, the pre-occupancy state 524 represents the time period between the time the controllers start active control of the HVAC equipment and the time occupancy starts. The pre-occupancy time period gives the HVAC equipment time be make the building environment comfortable prior to occupants arriving. The length of the pre-occupancy time period may be determined by the start time optimizer 400. The start time optimizer may monitor occupancy sensors, load on the HVAC equipment, time of day (e.g., relative to an occupancy schedule), or signal from another controller (e.g., start time optimizer 400) etc. to determine if the state machine should transition to an occupied state 522. For example, the transition to the occupied state may occur after a fixed amount of time, after the time the environment was expected to become occupied and/or when the condition reaches the threshold (e.g., enters the desired range).

Referring back to FIG. 4, a scheduler 412 is configured to determine the times at which a condition (e.g., temperature, CO2, humidity, etc.) controlled by the HVAC equipment should meet a specified criterion (e.g., within a range, less than a threshold, etc.) according to some embodiments. For example, the scheduler 412 may be configured to output time periods where the environment is expected to be occupied and therefore the HVAC equipment should be controlled to cause the temperature to be within a comfort range. The scheduler 412 may be configured to determine the scheduled times for the condition to be met using various methodologies. For example, the scheduler 412 may receive schedules from a user interface (e.g., entered by an operator of the building environment), by subscribing for data through an API (e.g., subscribing to a calendar for a meeting room), using rule based approaches based on a variable that indicates occupancy (e.g., heat load, CO2, occupancy sensor output), or using machine learning techniques (e.g., a neural network, etc.) based on the variable that indicates occupancy.

In some embodiments, the scheduler 412 may subscribe (e.g., request, etc.) to one or more data sources for the scheduled time the condition is to be met. Interface generate 438 may provide an instructions to generate a user interface that includes a method for creating a schedule (e.g., text entry fields, time selection drop-down menus, etc.) and instructions to use an API that can be used to store scheduled times within the start time optimizer 400. The scheduler 412 may request this information form the interface generator to be used to determine the times at which the condition should meet the specified criterion. The scheduler 412 may request information from any controller (e.g., equipment controller 452, supervisory controller 454, and/or remote monitoring and control system 456) that may include a schedule already entered by an operator indicating at what times the condition should be met. For example, the control strategy of an equipment controller 452 may already include occupancy schedules. The scheduler 412 may also request information from a calendar reservation system for the zone, space, room, etc. that includes the environment being controlled.

The calendar may provide times at which the environment is reserved and therefore expected to be occupied.

Figure 6A:
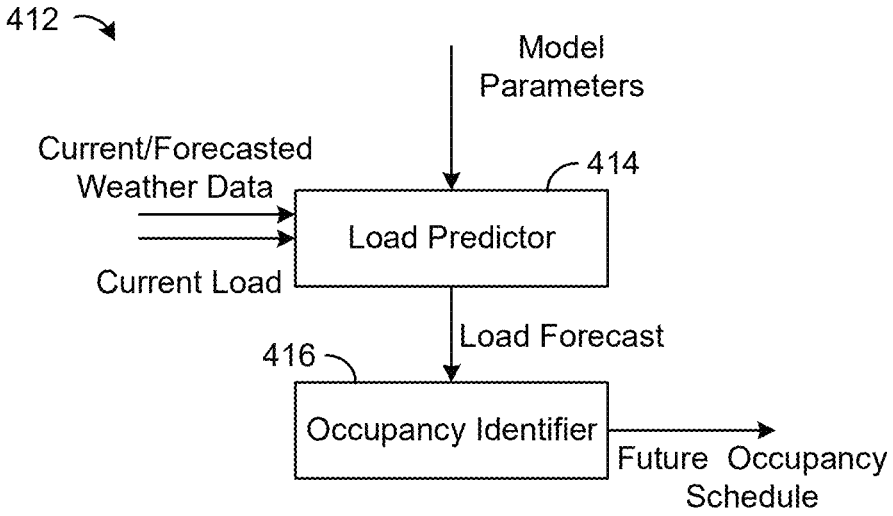
FIG. 6A is a data flow diagram for predicting an occupancy schedule, according to some embodiments.

In some embodiments, the scheduler 412 may be configured to predict a variable that indicates occupancy and generate the scheduled times the condition is to be met. FIG. 6A is a schematic block diagram of the scheduler 412 according to some embodiments. FIG. 6A describes an embodiment wherein HVAC load is predicted to determine future occupancy schedules. However, it is contemplated that other variables indicating occupancy (e.g., CO2, air flow) may be used in a similar configuration.

The scheduler 412 of FIG. 6A includes a load predictor 414. The load predictor 414 may include a model type (e.g., format, equation, etc.) within which model parameters can affect the predictions to configure the load predictor 414 for a particular environment. The load predictor 414 may predict a timeseries over a future prediction horizon based on the current load and the current/forecasted weather. The load predictor 414 may be part of the scheduler 412 as shown in FIG. 6A or a separate component of the start time optimizer 400 as shown in FIG. 4.

Regression techniques and/or system identification may be used to determine the model parameters used by the load predictor 414. For example, a model manager 420 may include a model identifier 422 to obtain the parameters and then store the parameters in one of the models 424. Time series prediction may be performed using the techniques found in U.S. Pat. No. 11,803,174 granted on Oct. 31, 2023, the entirety of which is herein incorporated by reference. Dynamic system-based techniques to identify a model and predict internal generations of heat load can be found in U.S. Pat. No. 11,215,375 granted on Jan. 4, 2022, the entirety of which is herein incorporated by reference.

The load (or other indicator of occupancy) forecast may be provided to the occupancy identifier 416. The occupancy identifier 416 may be configured to output a future occupancy schedule based on the load forecast provided. In some embodiments, the occupancy identifier 416 includes a number of criteria used to determine if the load (or other indicator of occupancy) is representative of an occupied time period. The occupancy identifier 416 may additionally calculate the derivative of the load prediction (e.g., using a finite difference equation) an determine if the derivative satisfies certain criteria. For example, the occupancy identifier 416 may consider the start of occupancy any time the derivative of the load prediction is greater than a first threshold for a first number of samples and the load prediction is greater than a second threshold. Similarly, the occupancy identifier 416 may consider the end of occupancy any time the derivative of the load prediction is more negative than a third threshold for a second number of samples and the load prediction is less than a fourth threshold. The occupancy identifier 416 may be similarly used to determine the current occupancy status (e.g., using recent past data of the load or previous predictions of the load) or the occupancy identifier 416 may use a different source of current occupancy data (e.g., an occupancy sensor).

In some embodiments, the parameters of the occupancy identifier 416 may learn good parameters (e.g., the first, second, third, and fourth thresholds, and the first and second number of samples) based on training data. For example, training data with historical load profiles and historical occupancy profiles can be used to determine parameters that optimize a learning objective. The learning objective may include the classification error between occupied and unoccupied time periods, a regularization term that penalizes between occupied and unoccupied time periods, or any other term that may be useful in training the occupancy identifier 416.

In some embodiments, the occupancy identifier 416 includes an artificial intelligence (AI) model, for example, to determine the occupied time periods. The AI model may be any type of machine learning architecture including, but not limited to, neural networks, convolutional neural networks, transformer models, recurrent neural networks, long-short term models, etc. The parameters (e.g., weights) of the AI model may be found using the training data with historical load profiles and historical occupancy profiles and any objective function related to the determination (e.g., classification) of time periods between occupied and unoccupied states as described previously.

In some embodiments, the functionality of the load predictor 414 and the occupancy identifier 416 can be combined into a single AI model that generates the occupancy schedule based on the time of day, the weather conditions and forecasts, the current load, and/or any other variables that are determined to be indicative of occupancy. In some embodiments, historical occupancy data (e.g., obtained from an occupancy sensor) is used to train an occupancy predictor based on time of day, day of week, the current occupancy state, etc.

Figure 6B:
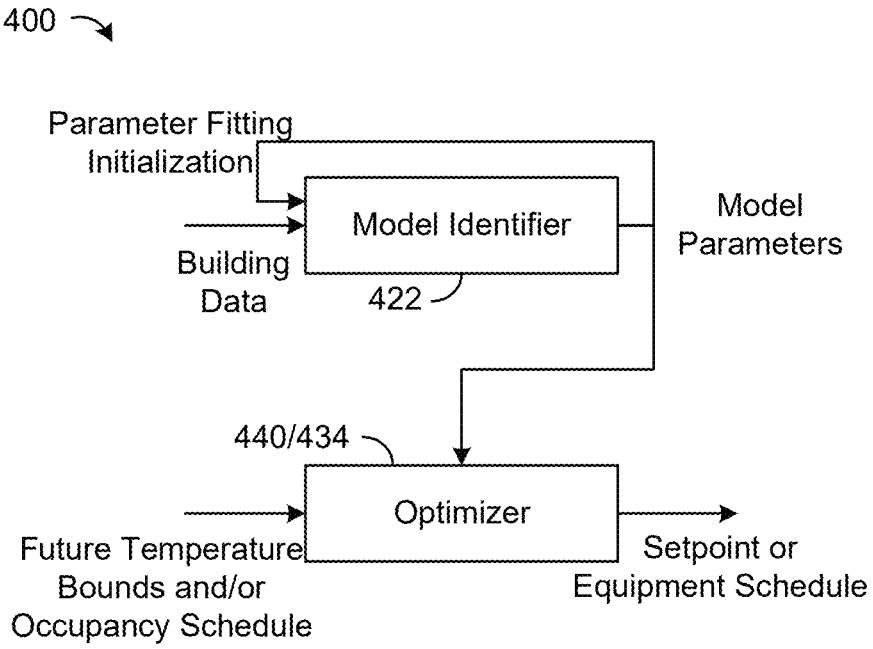
FIG. 6B is a data flow diagram for optimizing start time, according to some embodiments.

In some embodiments, determining the best time to cause the controller of the HVAC equipment to begin to condition the environment (e.g., enter an occupied state, change the setpoint, etc.) includes performing a simulation of the condition (e.g., temperature, CO2, etc.). A simulator 432 uses the models 424 from the model manager 420 to perform the simulations. FIG. 6B shows a block diagram describing the data flow between the model identifier 422 and an optimizer (e.g., the comparison-based optimizer 434 or the objective-based optimizer 440). The model identifier 422 may be configured to learn (e.g., identify parameters for, etc.) one or more models describing behavior of the condition in various control modes. For example, the model identifier 422 may learn a model for but an active control state (e.g., when the HVAC equipment is controlling to a setpoint) and an inactive control state (e.g., when the HVAC equipment is not producing an output, the environment is unoccupied, and/or the condition does not need to satisfy the criteria).

In some embodiments, the model identifier 422 uses previous or initial model parameters and historical building data to determine new parameters for the model. The model identifier 422 may run the algorithm on demand (e.g., when a user selects to update the model, based on goodness of fit criterion, or based on a new data threshold, etc.) and/or periodically (e.g., every two weeks, each month, etc.) and provide updated model parameters to the optimizer.

To facilitate the description of the optimization (e.g., using the comparison-based optimizer 434 or using the objective-based optimizer 440) temperature is used as the condition or variable that the HVAC equipment is controlling. The start time optimizer 400 will be described as causing the HVAC equipment to control the temperature to satisfy a comfort range (e.g., the criterion) during the occupied time periods. However, one skilled in the art will recognize that other conditions, for example CO2 concentration, evolve using similar models and in some embodiments, the start time optimizer 400 may be cause the HVAC equipment to start at a time that causes the other conditions to satisfy one or more different criteria (e.g., controlling humidity, CO2 concentration, allergens, air quality, or other building conditions to achieve corresponding setpoints or ranges during occupied time periods).

In some embodiments, the dynamic behavior of the temperature of the environment (e.g., zone, space, room, etc.) is described by:

$$\frac{dT}{dt} = f(T, T^h, T^c, t) = \begin{cases} f^c(T, T^c, t) & \text{if } T \geq T^c \\ f^d(T, t) & \text{if } T^h < T < T^c \\ f^h(T, T^h, t) & \text{if } T \leq T^h \end{cases}, \quad \text{equation 1}$$

where $$\frac{dT}{dt}$$

is the derivative of the temperature with respect to time, $f^c$ represents the behavior of the temperature when the HVAC equipment is performing cooling (e.g., when the temperature T is above the cooling setpoint $T^c$), $f^h$ represents the behavior of the temperature when the HVAC equipment is performing heating (e.g., when the temperature T is below the heating setpoint $T^h$), and $f^d$ represents the behavior of the temperature when the HVAC equipment is performing neither cooling nor heating (e.g., when the temperature is "drifting" based on the internal loads and the weather conditions and the HVAC equipment is not affecting the temperature). For example, $f^c$ and $f^h$ may be modeled by first order approach to the respective setpoint:

$$f^c = -k_c(T - T^c), \text{ and} \quad \text{equation 2}$$

$$f^h = k_h(T^h - T), \quad \text{equation 3}$$

and $f^d$ may be modeled by a linear increase or decrease:

$$f^d = c_d. \quad \text{equation 4}$$

The models described by equations 1-4 may be stored by the model manager 420 as represented by models 424 1–n.

In some embodiments, the parameters of the temperature models vary with time. For example, $c_d$ may be affected by the outdoor air temperature, a hot outdoor air temperature causing the $c_d$ to be more positive and the temperature to drift to increased temperatures faster. Additionally or alternatively, the models used during active control to a setpoint (e.g., equations 2 and 3) may include a maximum slope representing the cooling or heating capacity of the HVAC equipment. For example, the dynamic behavior of the temperature may use alternative equations:

$$f^c = \max(-k_c(T - T^c), -c_c), \quad \text{and equation 2b}$$

$$f^h = \min(k_h(T^h - T), c_h), \quad \text{equation 3b}$$

where $c_c$ is related to the cooling capacity of the HVAC equipment and $c_h$ is related to the heating capacity of the HVAC equipment. In some embodiments, the model of $f^d$ includes remaining constant upon reaching a relaxed temperature bound. For example, the temperature behavior may use the alternative equation:

$$f^d = \begin{cases} 0 & T = T^{cr} \\ c_d & T^{hr} < T < T^{ce} \\ 0 & T = T^{hr} \end{cases}, \quad \text{equation 4b}$$

where $T^{hr}$ is a relaxed heating setpoint (e.g., less than $T^h$) and $T^{cr}$ is a relaxed cooling setpoint (e.g., greater than $T^c$).

Various methods may be used to determine the parameters of the models described by equations 1-4 and/or other forms of the model for predicting the temperature (or other physical property) of the environment. In some embodiments, historical data is collected for identifying (e.g., training, fitting, etc.) the models. The historical data may relate the physical property to other independent variables that can drive (e.g., cause changes to) the physical property. For example, if the physical condition is temperature, the historical data may relate the environment's temperature to the heating and/or cooling load (e.g., as described above), the outdoor weather conditions, previous temperatures withing the environment (e.g., to estimate the temperature of the furniture, walls, etc.), the amount of electric equipment operating in the environment, etc. System identification and/or parameter fitting procedures may use the historical data to determine parameters for the models.

In some embodiments, some or all of the parameters may be determined using manufacturers specifications for the equipment. Specifications may list the maximum capacity of the equipment, which when combined with space size, amount of fresh air that is to be conditioned, temperature of outside air, etc. can be used to determine the parameters of the model. Additionally or alternatively, the configuration parameters of the HVAC control system may provide information related to the equipment models. The control systems may have maximum ramp rates and/or equipment capacities already programmed into the memory. This information may be communicated to the start time optimizer 400 for use in model determination. In some embodiments, the control algorithm may have already performed some learning or tuning process that can provide insight into the parameters that may be used when the HVAC equipment is in active control. For example, the gain and the integral time of existing PI controllers may be used to determine values for the $k_c$ and $k_h$ parameters in equations 2 and 3.

The start time optimizer 400 may include a simulator 432 to simulate the temperature of the environment by executing the models 424 (e.g., equations 1-4). The simulator 432 may convert equations 1-4 into a discrete time representation that facilitates simulation on a computer. For example, a Euler approximation may be used to convert the equations into their discrete time counterparts, using exponentials of matrices, or any other suitable discretization technique. In some embodiments, the simulator is configured to simulate systems in reverse time. For example, given the states of the system and or a number of measurements calculate the previous temperature to get to the current value.

Figure 7:
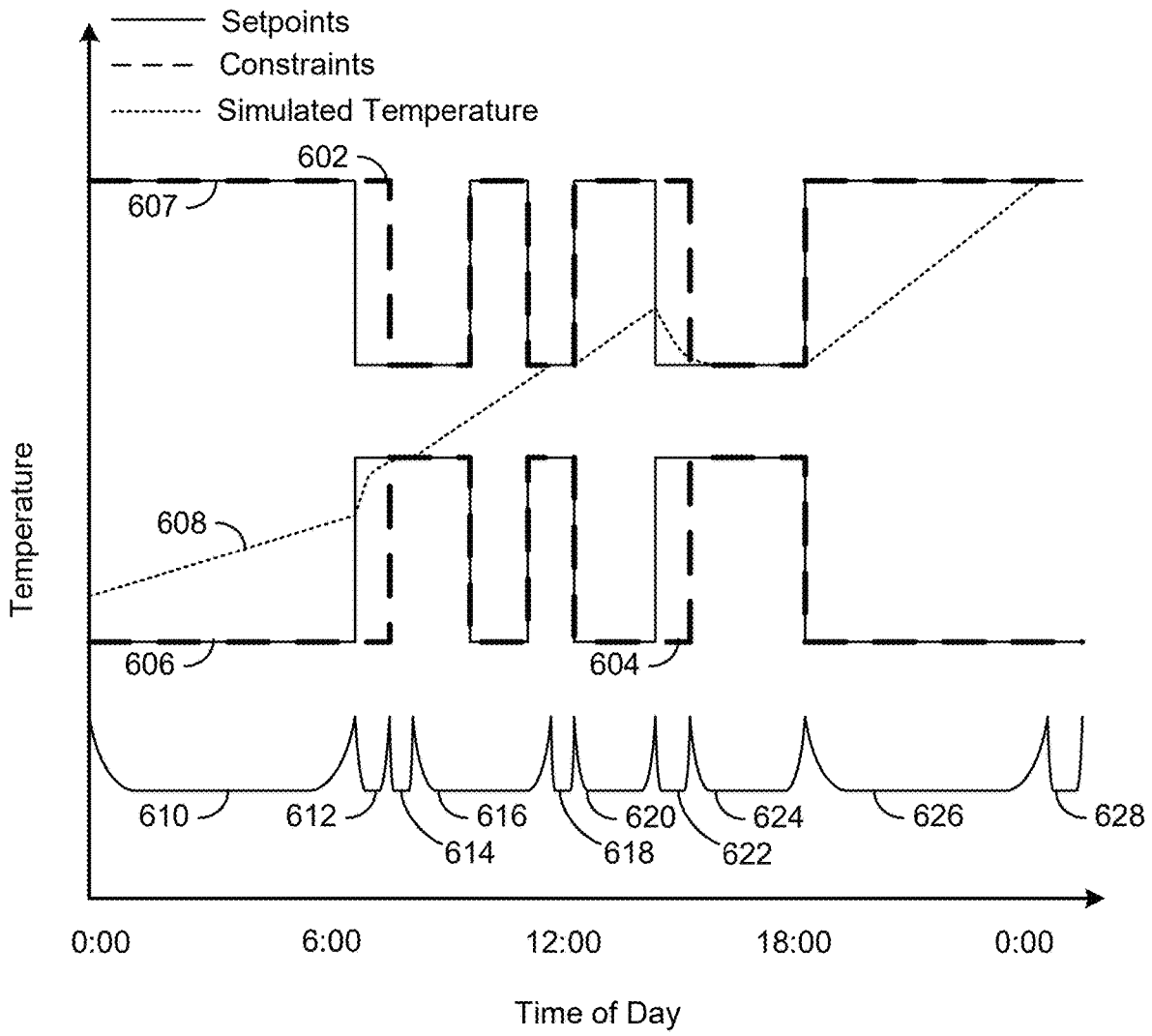
FIG. 7 is a plot of setpoints, temperature constraints, and a simulated temperature, according to some embodiments.

FIG. 7 shows the behavior of a temperature simulation. Trace 608 is the simulated temperature using the temperature models given the setpoints $T^c$ (e.g., trace 607) and $T^h$ (e.g., trace 606). It is noted that the majority of the time the setpoints are equal to the constraints (e.g., constraint 602 and 604) the exception exists when the start time optimizer cause the setpoints (e.g., trace 606 and 607) to change in advance of the constraint such that the temperature reaches the level of the constraint prior to the constraint changing. In some embodiments, the temperature setpoints are tighter than the constraints (e.g., by 0.5° F.) because (i) this allows a margin for control inaccuracy while maintaining the temperature within the constraints and (ii) the temperature described by equations 1-4 will never reach the setpoint value (e.g., the temperature asymptotically approaches the setpoint) and a margin allows a time that the constraint is satisfied to be calculated.

Still referring to FIG. 7 an example of the behavior of the temperature simulated using equations 1-4 is described.

Time period 610 is illustrative of drift using equations 1 and 4. For example, the outdoor temperature may have warmed up overnight and now the temperature is increasing at a given slope equal to the current value of ca. Time period 612 is illustrative of the setpoints being driven in advance of the constraints so that the temperature has time to warm up prior to the occupied constraints. During time period 612, equations 1 and 3 are used as the HVAC equipment actively heats the environment. During time period 614, the constraints are tightened and the temperature still follows equations 1 and 3 and the HVAC equipment maintains the temperature at the setpoint by continuing to heat the environment. At the beginning of time period 616, the heat entering the environment from sources other than the HVAC equipment (e.g., internal generation and/or warmer weather conditions) has caused the temperature to drift from the heating setpoint. During time period 616, equations 1 and 4 are again used to simulate the temperature of the environment using the increased value of $c_d$ (e.g., increased by the current weather conditions or internal load generation). During time period 618, the HVAC equipment is providing cooling to maintain the temperature at the cooling setpoint. During time period 618, the equations 1 and 2 are used to describe the temperature, but because the temperature is already at the temperature setpoint it maintains that value. During time period 620, the constraints are relaxed (e.g., the occupants have left the zone) and the drift model (e.g., equations 1 and 4) is again used to simulate the temperature. During time periods 622 and 624, the HVAC equipment is in cooling mode and the equations 1 and 2 are used to simulate the temperature. At the end of the day (e.g., time period 626 and 628) the occupants may have left the building and the constraints are relaxed. During time period 626, the drift model of equations 1 and 3 can be used to describe the temperature changes. Finally, at the beginning of time period 628, weather conditions have heated the building to the relaxed cooling setpoint the HVAC equipment must provide cooling to maintain the temperature.

Referring back to FIG. 4, the start time optimizer 400 may include a comfort manager 430. In some embodiments, the comfort manager 430 is configured to use the output from the scheduler 412 to generate a time series of constraints for the temperature of the environment. The comfort manager 430 may produce tight constraints (e.g., temperature bounds are close together) during time periods that are expected to be occupied and loose constraints (e.g., temperature bounds are further apart) during time periods that are expected to be unoccupied. For example, the comfort manager 430 may generate constraints similar to constraints 602 and 604 in FIG. 7.

The start time optimizer 400 may include a comparison-based optimizer 434. In some embodiments, the comparison-based optimizer 434 is configured to compare simulations produced by the simulator 432 and determine when the start time optimizer 400 should cause the HVAC equipment to start cooling and/or heating the environment. For example, the start time optimizer 400 may determine a transition time period before the environment is occupied that if the HVAC equipment begin controlling to a setpoint the temperature will satisfy the comfort bounds just as occupancy begins. During the transition time period the HVAC equipment may be "pre-conditioning" the environment (e.g., providing heating, cooling, and/or ventilation) so that the environment is in an appropriate state for occupancy when occupants arrive. Pre-conditioning may refer to any activation of the HVAC equipment prior to a constraint (e.g., criterion) becoming active (or tighter) to cause the constraint to be met at the time it becomes active. FIGS. 8A-8L illustrate the methods used by the comparison-based optimizer 434.

In some embodiments, the comparison-based optimizer 434 will request the simulator 432 perform (i) a forward simulation using equations 1-4 initialized at the current time and values of the state (e.g., to determine the next time the HVAC equipment should enter an active control mode) or initialized at the time the temperature constraints are relaxed (e.g., to determine future a future schedule) and (ii) a backward simulation from each time a temperature constraint is tightened using the equations 1 and 2 or 3 depending on the constraint that is tightened. For example, if the cooling constraint is tightened, equations 1 and 2 may be used and if the heating constraint is increased, equations 1 and 3 may be used. The comparison-based optimizer 434 may determine the time the HVAC equipment should begin controlling based on the earliest intersection of the two simulations of a forward simulation and a backward simulation. Intersection or coincidence may be used interchangeably to describe the time when the two simulations have (or are estimated to have) equal values of the temperature (or another physical property being simulated). It is noted that because of the asymptotic nature of the temperature response using equations 2 or 3 it may be useful to initialize the backward simulation an amount away from the temperature bounds (e.g., 0.5° F.). Several scenarios are illustrated in FIGS. 8A-8I.

FIG. 8A illustrates the calculations performed by the comparison-based optimizer 434 in a scenario with a relatively light load requiring cooling, according to some embodiments. Temperature constraints 702*a* and 704*a* are shown to loosen towards the beginning of the plot and tighten again towards the end of the plot (initial temperature bounds are covered by temperatures setpoints 712*a* and 714*a*). The comparison-based optimizer 434 may request the simulator 432 to perform a forward simulation (shown as simulated temperature 706*a*) using equations 1 and 4 based on an expected drift at that time given the load, time of day, etc. The comparison-based optimizer 436 may also request the simulator 432 to perform a backward simulation (shown as simulated temperature 708*a*) using equations 1 and 3 for the heating constraint 704*a* such that the simulated temperature is a margin 720*a* below the tightened value of the heating constraint 704*a* at the time the heating constraint 704*a* increases. The comparison-based optimizer 436 may also request the simulator 432 to perform a backward simulation (shown as simulated temperature 710*a*) using equations 1 and 2 for the cooling constraint 702*a* such that the simulated temperature is a margin 718*a* above the tightened value of the cooling constraint 702*a* at the time the cooling constraint 702*a* decreases. The comparison-based optimizer 434 may determine the beginning of the transition period 716*a* based on the intersection of the two simulations (e.g., where the simulations 706*a* and 710*a* coincide) and the start time optimizer 400 may send a signal to the HVAC controller and/or the HVAC equipment to enter an active control mode at that time. For example, the start time optimizer 400 may cause the controller to change the heating setpoint 714*a* and the cooling setpoint 712*a* at that time to cause the HVAC equipment to begin active control.

Determining the intersection may provide an optimal time to start the equipment operating in the active control mode (e.g., least run time prior to the beginning of occupancy). It is noted that the equipment does not need to run at maximum capacity (e.g., maximum heating output or maximum cooling rejection). In some embodiments, the backwards prediction is performed for multiple time update equations representing different maximum heating and cooling outputs (and an optimal time to start the equipment found for each of the maximum heating/cooling capacities). The maximum heating and/or cooling output of may be selected based on the different simulations and resulting optimal start times. The maximum heating and/or cooling capacity can be communicated to the equipment and/or controller to ensure that the heating and/or cooling output does not exceed this capability (e.g., even if the equipment has the capability). Advantageously, it is possible to optimize the start time based on satisfying the criterion as the occupied time period begins and to determine an optimal start time for equipment running at lower capacities (e.g., to reduce demand charges and/or to operate at an efficient level of heat production or heat rejection). Selecting the maximum capacity to be used may be performed by a second optimization process. For example, the capacity selection problem can be defined as a single variable optimization problem and solved using a golden section search algorithm. The second optimization process may determine the maximum percent capacity (e.g., heat production or rejection) that minimizes a cost function (e.g., a weighted objective of demand charge and energy usage). The computational efficiency of finding the intersection of the forward and backward simulations and the computational efficiency of the golden section search algorithm may allow for solving the second optimization process efficiently.

FIG. 8B illustrates the calculations performed by the comparison-based optimizer 434 in a scenario with a relatively light load requiring heating, according to some embodiments. Temperature constraints 702*b* and 704*b* are shown to loosen towards the beginning of the plot and tighten again towards the end of the plot (initial temperature bounds are covered by temperatures setpoints 712*b* and 714*b*). The comparison-based optimizer 434 may request the simulator 432 to perform a forward simulation (shown as simulated temperature 706*b*) using equations 1 and 4 based on an expected drift at that time given the load, time of day, etc. The comparison-based optimizer 436 may also request the simulator 432 to perform a backward simulation (shown as simulated temperature 708*b*) using equations 1 and 3 for the heating constraint 704*b* such that the simulated temperature is a margin below the tightened value of the heating constraint 704*b* at the time the heating constraint 704*b* increases. The comparison-based optimizer 436 may also request the simulator 432 to perform a backward simulation (shown as simulated temperature 710*b*) using equations 1 and 2 for the cooling constraint 702*b* such that the simulated temperature is a margin above the tightened value of the cooling constraint 702*b* at the time the cooling constraint 702*b* decreases. The comparison-based optimizer 434 may determine the beginning of the transition period 716*b* based on the intersection of the two simulations (e.g., where the simulations 706*b* and 708*b* coincide) and the start time optimizer 400 may send a signal to the HVAC controller and/or the HVAC equipment to enter an active control mode at that time. For example, the start time optimizer 400 may cause the controller to change the heating setpoint 714*b* and the cooling setpoint 712*b* at that time to cause the HVAC equipment to begin active control. In the scenario of FIG. 8B the forward simulation never intersects with the backward simulation 710*b* because heating is driving the temperature to drift down; thus 708*b* is intersected first.

FIG. 8C illustrates the calculations performed by the comparison-based optimizer 434 in a scenario with a heavy requiring cooling, according to some embodiments. Temperature constraints 702*c* and 704*a* are shown to loosen towards the beginning of the plot and tighten again towards the end of the plot (initial temperature bounds are covered by temperatures setpoints 712*c* and 714*c*). The comparison-based optimizer 434 may request the simulator 432 to perform a forward simulation (shown as simulated temperature 706*c*) using equations 1 and 4 based on an expected drift at that time given the load, time of day, etc. The comparison-based optimizer 436 may also request the simulator 432 to perform a backward simulation (shown as simulated temperature 708*c*) using equations 1 and 3 for the heating constraint 704*c* such that the simulated temperature is a margin below the tightened value of the heating constraint 704*c* at the time the heating constraint 704*c* increases. The comparison-based optimizer 436 may also request the simulator 432 to perform a backward simulation (shown as simulated temperature 710*c*) using equations 1 and 2 for the cooling constraint 702*c* such that the simulated temperature is a margin above the tightened value of the cooling constraint 702*c* at the time the cooling constraint 702*c* decreases. The comparison-based optimizer 434 may determine the beginning of the transition period 716*c* based on the intersection of the two simulations (e.g., where the simulations 706*c* and 710*c* coincide) and the start time optimizer 400 may send a signal to the HVAC controller and/or the HVAC equipment to enter an active control mode at that time. For example, the start time optimizer 400 may cause the controller to change the heating setpoint 714*c* and the cooling setpoint 712*c* at that time to cause the HVAC equipment to begin active control. In the scenario of FIG. 8C the transition period found is longer, giving time for the HVAC equipment to cool the temperature down the larger amount in response to the temperature drifting to a higher temperature.

FIG. 8D illustrates the calculations performed by the comparison-based optimizer 434 in a scenario with a relatively light load requiring heating, according to some embodiments. Temperature constraints 702*d* and 704*d* are shown to loosen towards the beginning of the plot and tighten again towards the end of the plot (initial temperature bounds are covered by temperatures setpoints 712*d* and 714*d*). The comparison-based optimizer 434 may request the simulator 432 to perform a forward simulation (shown as simulated temperature 706*d*) using equations 1 and 4 based on an expected drift at that time given the load, time of day, etc. The comparison-based optimizer 436 may also request the simulator 432 to perform a backward simulation (shown as simulated temperature 708*a*) using equations 1 and 3 for the heating constraint 704*d* such that the simulated temperature is a margin below the tightened value of the heating constraint 704*d* at the time the heating constraint 704*d* increases. The comparison-based optimizer 436 may also request the simulator 432 to perform a backward simulation (shown as simulated temperature 710*d*) using equations 1 and 2 for the cooling constraint 702*d* such that the simulated temperature is a margin above the tightened value of the cooling constraint 702*d* at the time the cooling constraint 702*d* decreases. The comparison-based optimizer 434 may determine the beginning of the transition period 716*d* based on the intersection of the two simulations (e.g., where the simulations 706*d* and 708*d* coincide) and the start time optimizer 400 may send a signal to the HVAC controller and/or the HVAC equipment to enter an active control mode at that time. For example, the start time optimizer 400 may cause the controller to change the heating setpoint 714*d* and the cooling setpoint 712*d* at that time to cause the HVAC equipment to begin active control. In the scenario of FIG. 8D the transition period found is longer, giving time for the HVAC equipment to warm the temperature the larger amount in response to the temperature drifting to a cooler temperature (e.g., due to cooler weather outside).

In some scenarios, the simulated temperature may not be at a temperature setpoint (e.g., cooling or heating) at the time the constraints are relaxed. For example, the heat generated within the environment and/or the outdoor temperature may increase. In such a scenario, the forward temperature simulation may be simulated using equations 1 and 3 initiated at the last time the temperature is expected to be at a temperature bound. FIG. 8E illustrates the calculations performed by the comparison-based optimizer 434 in a such a scenario. FIG. 8E shows the temperature constraints 702*e* and 704*e*, the temperature setpoints 712*e* and 714*c*, the simulated temperatures 706*c*, 708*e*, and 710*c*, and the expected transition period 716*e*. The forward simulated temperature 706*e* begins it simulation when the load is high enough to cause the temperature to drift from the heating setpoint (e.g., when no heating is required to maintain the temperature at the cooling setpoint). The beginning of the transition period 716*e* may still be found by the comparison-based optimizer 434 by determining when the simulations intersect.

FIG. 8G shows the temperature constraints 702*g* and 704*g*, the temperature setpoints 712*g* and 714*g*, the simulated temperatures 706*g*, 708*g*, and 710*g*, and the expected transition period 716*g* for another set of simulations. In some scenarios, the forward simulated temperature may not intersect a backward simulated temperature as shown in FIG. 8G. In such scenarios, no transition time is required and the temperature setpoints (e.g., setpoints 712*g* and 714*g*) may be changed at the same time as the temperature constraints (e.g., constraints 702*g* and 704*g*).

In some scenarios, the parameter $c_d$ of equation 4 may change with time. For example, $c_d$ may be predicted based on the time of day, the day of week, and/or the outdoor weather conditions. In some embodiments, the value of $c_d$ is based on the output of the load predictor 414. For example, if the heat entering an environment (e.g., zone, space, etc.) is known, $c_d$ can be determined based on the current heat transfer into the environment and a value related to the capacitance of the environment.

$$c_d = \frac{\dot{Q}_e}{C_e}. \qquad \text{equation 5}$$

where $\dot{Q}_e$ represents the current heat transfer into the environment and $C_e$ is the value related to the capacitance of the environment. For example, $C_e$ may be determined from the capacitance of the air in the environment and the furniture, walls, etc. in the environment. FIG. 8F shows the temperature constraints 702*f* and 704*f*, the temperature setpoints 712*f* and 714*f*, the simulated temperatures 706*f*, 708*f*, and 710*f*, and the expected transition period 716*f* for such a scenario. In the scenario depicted in FIG. 8F, the heat transfer is shown to decrease with time causing the concave shape of the forward simulated temperature 706*f*.

FIG. 8H shows the temperature constraints 702*h* and 704*h*, the temperature setpoints 712*h* and 714*h*, the simulated temperatures 706*h*, 708*h*, and 710*h*, and the expected transition period 716*h* for another set of simulations. In the scenario depicted in FIG. 8H, the heat transfer is shown to increase with time causing the convex shape of the forward simulated temperature 706*h*.

In any scenario, including those depicted in FIGS. 8A-8I the comparison-based optimizer 434 may choose a time where the forward simulation intersects a backward simulation to begin the transition period.

In some embodiments, the expected rate of change of the temperature is high enough that the temperature simulation using equations 1 and 4 intersects the relaxed temperature constraint 702 (e.g., raised cooling setpoint or lowered heating setpoint). If the temperature of the environment were to reach the relaxed setpoint the HVAC equipment may begin conditioning the environment to maintain the temperature near the relaxed setpoint (e.g., by controlling to the relaxed setpoint or performing on/off control wherein the system is on for a period of time and then off for a period of time). In such a scenario, the forward simulation may be assumed to follow the relaxed temperature constraint and the intersection be chosen where the backwards simulation intersects the temperature constraint (and the forward simulation of the temperature which is assumed to remain at the temperature constraint).

FIG. 8I shows the temperature constraints 702*i* and 704*i*, the temperature setpoints 712*i* and 714*i*, the simulated temperatures 706*i*, 708*i*, and 710*i*, and the expected transition period 716*i* for another set of simulations. In the scenario depicted in FIG. 8I, the entering the environment (e.g., zone, space, room, etc.) is shown to be large enough that the forward simulated temperature 706*i* reaches the relaxed cooling temperature constraint 712*i* prior to intersected the backward simulated temperature 710*i*. The forward simulated temperature 706*i* may follow the relaxed temperature constraint 712*i* and thus the transition period 716*i* begins when the backward simulated temperature 710*i* intersects the relaxed temperature constraint and the forward simulated temperature 706*i*.

In some embodiments, the controller the parameter of the forward simulation model (e.g., $c_d$ of equation 4) depends on various factors including future weather conditions, number of occupants, etc. These factors may not be precisely known nor the relation between the parameter and the factors known. It may be advantageous to perform a stochastic simulation for the forward simulation (or backward simulation). A stochastic simulation may include generating (e.g., calculating, simulating, etc.) a confidence range for the forward simulation. The confidence range, for example, can be defined by an upper and lower percentile limit (e.g. a 0.95 limit for which 95% of all outcomes of the actual future temperatures are less than the limit and a 0.05 limit for which 5% of all outcomes of the actual future temperatures are less than the limit.). Methods for calculating the bounds of the confidence range may include calculating a probability density function (pdf) and perform a forward simulation using the 95 percentile value for $c_d$ and the 5 percentile value for ca. Additionally or alternatively, a random walk may be added to an average (e.g., expected) temperature trajectory. The parameters of the random walk may depend on the uncertainty in the parameter $c_d$ and/or how much the parameter may change over time. Depending on the stochastic model, the upper and/or lower confidence bounds (e.g., percentile limits) may be linear (e.g., defining an angle whereby the temperature limits expand as time goes forward) or the confidence bounds may be nonlinear.

FIGS. 8J-8L illustrate determining the transition time 816 by stochastic simulation with confidence range for the temperature. FIG. 8J illustrates the calculations performed by the comparison-based optimizer 434 when a confidence range is calculated for the forward simulation. Temperature constraints 702*j* and 704*j* are shown to loosen towards the beginning of the plot and tighten again towards the end of the plot (initial temperature bounds are covered by temperatures setpoints 712*j* and 714*j*). The comparison-based optimizer 434 may request the simulator 432 to perform a forward simulation and a confidence range including an upper and calculate a lower confidence bound (e.g., percentile limits, etc.) for the simulated temperature (shown as upper confidence bound 722*j* and lower confidence bound 724*j*). The comparison-based optimizer 436 may also request the simulator 432 to perform a backward simulation (shown as simulated temperature 708*j*) using equations 1 and 3 for the heating constraint 704*j* such that the simulated temperature is a margin below the tightened value of the heating constraint 704*j* at the time the heating constraint 704*j* increases. The comparison-based optimizer 436 may also request the simulator 432 to perform a backward simulation (shown as simulated temperature 710*j*) using equations 1 and 2 for the cooling constraint 702*j* such that the simulated temperature is a margin above the tightened value of the cooling constraint 702*j* at the time the cooling constraint 702*j* decreases. The comparison-based optimizer 434 may determine the beginning of the transition period 716*j* based on the first time of an intersection of (i) the upper confidence bound or lower confidence bound and (ii) the backward simulation 710*j* from the cooling constraint 702*j* or the backward simulation 708*j* from the heating constraint 704*j* occurs. In the scenario of FIG. 8J the upper confidence bound 722*j* intersects with the backward simulation 710*j* and the lower confidence bound 724*j* intersects with the backward simulation 708*j*. The intersection of the upper confidence bound 722*j* and the backward simulation 710*j* occurs first and this time may be used as the beginning of the transition period 716*j*.

FIG. 8K shows the temperature constraints 702*k* and 704*k*, the temperature setpoints 712*k* and 714*k*, the backwards simulated temperatures 708*k*, and 710*k*, and the upper and lower confidence bounds 722*k* and 724*k*, respectively. The temperature is expected to drift up and the upper confidence bound 722*k* intersects the backwards simulation 710*k* and the beginning of the transition period 716*k* may be chosen at the same time as this intersection. It is contemplated that as the actual time of day is closer to the beginning of the transition time period, the confidence range may get smaller (e.g., there is more certainty in the forward temperature simulation) if the calculations are repeated and if the actual temperature follows the expected trajectory (e.g., mean, middle of the two confidence bounds, etc.) the beginning of the confidence range may pull closer to the time the temperature constraints tighten. Eventually, the transition period may begin at the time the actual temperature intersects with the backward simulation 710*k*.

FIG. 8L shows the temperature constraints 702*l* and 704*l*, the temperature setpoints 712*l* and 714*l*, the backwards simulated temperatures 708*l*, and 710*l*, and the upper and lower confidence bounds 722*l* and 724*l*, respectively. The temperature is expected to drift downward and the lower confidence bound 724*l* intersects the backwards simulation 708*l* and the beginning of the transition period 716*l* may be chosen at the same time as this intersection. As shown in FIG. 8L a confidence bound may also follow the temperature constraints (e.g., for similar reasons as the simulated temperature 706*i* of FIG. 8I) and the transition time period 716*l* may begin where the backward simulation 708*l* intersects both the temperature bound 7041 and the lower confidence bound 724*l*.

FIGS. 8A-8L show both temperature setpoints 712, 714 being tightened at the same time. For example, cooling setpoint 712 is lowered and heating setpoint 714 is raised at the same time. In some embodiments, the cooling setpoint 712 and the heating setpoint 714 are independently calculated. For example, if the temperature is expected to drift to higher values the cooling setpoint may be lowered at the beginning of the transition period 716 and the heating setpoint may remain relaxed (e.g., lowered). If a stochastic simulation is performed, the cooling setpoint may be tightened (e.g., lowered) when the upper confidence limit 722 intersects with he backwards simulation 710. The heating setpoint may be independently tightened (e.g., raised) at the time the lower confidence limit 724 intersects with the backward simulation 708.

In some embodiments, the temperature constraints may be relaxed and tightened more than one time per day. For example, the environment may be a meeting room, a class room, or a similar variable occupancy zone and the temperature constraints may be relaxed and tightened several times a day as meetings and/or classes occur. The comparison-based optimizer 434 may use the simulator 432 to perform forward and backward simulations of the temperature for each of the time periods for which the constraints are relaxed and determine a transition time period for each of the time periods that are relaxed. The result (e.g., output) of the comparison-based optimizer may be a schedule that represents when the HVAC equipment is to be actively controlling the temperature so that it satisfies the comfort criteria (e.g., the bounds) and when the HVAC equipment should allow the temperature to drift (or control to wider setpoint bounds). The schedule may be predictive (e.g., include future time periods) with a horizon of a day, a week, or any time period found useful to display for operators. In some embodiments, the predictive schedule or portion thereof is also be sent to the equipment controllers 452, supervisory controllers 454, or any controller responsible for activating the HVAC equipment. By sending a predictive schedule the equipment may start at a near optimal time even if the connection to the computer hardware implementing the start time optimizer 400 is lost. For example, the last schedule received can be implemented until the connection is restored and a new schedule is obtained.

The comparison-based optimizer 434 provides several key advantages. For example, performing forward and backward simulations of a dynamic system model is computationally inexpensive, the computations can be performed on lightweight hardware (e.g., an edge device, terminal controllers, a smart thermostat, etc.) or cost and energy efficiently in the cloud. Environments (e.g., zones, spaces, rooms) can be calculated independently, an update to the occupancy schedule of one zone only affects that zone and other zones to not require new calculations. The parsimony of the models and algorithm allows the calculations to be performed with little historical data; thus value may be provided to the customer in the first days after deployment. Low data requirements allow for a simple commissioning procedure.

The procedures of generating a simulation and determining the optimal start time for more than one change in the temperature bounds (e.g., change in occupancy, etc.) can be combined into a given an algorithm for implementation within the controller or other computer hardware (e.g., cloud based architecture, etc.). An example, of such an algorithm uses the following definitions. Let $T^h$ and $T^c$ be the (time-varying and piecewise constant) lower and upper bounds for comfortable zone temperatures. Forward simulation function, $F(T^*, t^*, T^h, T^c, t)$: for $t \geq t^*$, may be used to simulate value of the temperature $T(t)$ assuming the system started at $T(t^*)=T^*$ with constant setpoints $T^h$ and $T^c$ after. For example, $F(T^*, t^*, T^h, T^c, t)$ may be equation 1 and 4 with the added parameter $t^*$ representing the time at the beginning of the simulation. Backwards simulation function $B(T^*, t^*, T^h, T^c, t)$: for $t \le t^*$, may be used to simulate the value of the temperature $T(t)$ assuming the system gets to $T(t^*)=T^*$ with constant setpoints $T^h$ and $T^c$ during that period. For example, the backwards simulation function $B(T^*, t^*, T^h, T^c, t)$ may be derived from equations 1-3 with the added parameter $t^*$ representing the time at the end of the simulation (e.g., the latest time chronologically). Also use the definitions:

$\mathcal{T}$ : set of time grid points (e.g., constant sample rate over the horizon)

$\mathcal{U}^c \subset \mathcal{T}$ : set of time points where $\overline{T}^c$ goes up $\mathcal{D}^c \subset \mathcal{T}$ : set of time points where $\overline{T}^c$ goes down $\mathcal{U}^h \subset \mathcal{T}$ : set of time points where $\overline{T}^h$ goes up $\mathcal{D}^h \subset \mathcal{T}$ : set of time points where $\overline{T}^h$ goes down For the changes in the cooling setpoints the algorithm is as follows according to some embodiments. For each of the times that the upper (e.g., cooling) temperature bound increases (e.g., for each $t_i \in \mathcal{U}^c \cup \{t\}$) The forward simulation can be performed using:

$$\hat{F}_i := \begin{cases} \infty & \text{if } t < t_i \\ F(\tilde{T}^c(t_i), t_i, -\infty, \infty, t) & \text{else} \end{cases}, \qquad \text{equation 6}$$

where $\tilde{T}^c(t_i)$ is the original value of $\overline{T}^c$ just before time $t_i$. Equation 6 may be used to predict the upward drift indefinitely into the future. Using $i^*=\text{argmin}_i \hat{F}_i$ as the index of the lowest temperature calculated for each of the times the cooling temperature bound decreases (e.g., for all $t_j \in \mathcal{D}^c$) the backwards simulation using:

$$\hat{B}_j = \begin{cases} B(\overline{T}^c(t_j), t_j, -\infty, \overline{T}^c(t_j), t) & \text{if } t < t_j \\ \infty & \text{else} \end{cases}, \qquad \text{equation 7}$$

where $\overline{T}^c(t_j)$ is the (newly decreased) value of $\overline{T}^c$ at time $t_j$. Equation 7 may be used to predict downward control indefinitely from the past. Using $j^*=\text{argmin}_j \hat{B}_j$ as the index of the lowest temperature, the cooling setpoint for a time t is given by:

$$T^c = \begin{cases} \overline{T}^c(t) & \text{if } \hat{F}_{i^*} \le \hat{B}_{j^*} \\ \overline{T}^c(t_{j^*}) & \text{else} \end{cases}, \qquad \text{equation 8}$$

For changes in the heating setpoints the algorithm is as follows according to some embodiments. For each of the times that the lower (e.g., heating) temperature bound decreases (e.g., for each $t_i \in \mathcal{D}^h \cup \{t\}$) the forward simulation can be performed using:

$$\hat{F}_i := \begin{cases} -\infty & \text{if } t < t_i \\ F(\tilde{T}^h(t_i), t_i, -\infty, \infty, t) & \text{else} \end{cases}, \qquad \text{equation 9}$$

Where $\tilde{T}^h(t_i)$ is the original value of $\overline{T}^h$ just before time $t_i$. Equation 9 may be used to predict the downward drift indefinitely into the future. Using $i^*=\text{argmax}_i \hat{F}_i$ as the index of the highest temperature for each of the times the heating temperature bound increases (e.g., for all $t_j \in \mathcal{U}^h$) the backwards simulation using:

$$\hat{B}_j = \begin{cases} B(\overline{T}^h(t_j), t_j, \overline{T}^h(t_j), \infty, t) & \text{if } t < t_j \\ -\infty & \text{else} \end{cases}, \qquad \text{equation 10}$$

where $\overline{T}^h(t_i)$ is the (newly increased) value of $\overline{T}^h$ at time $t_j$. Equation 10 may be used to predict upward control indefinitely from the past. Using $j^*=\text{argmin}_j \hat{B}_j$ as the index of the highest temperature, the cooling setpoint for a time t is given by:

$$T^h = \begin{cases} \overline{T}^h(t) & \text{if } \hat{F}_{i^*} \ge \hat{B}_{j^*} \\ \overline{T}^h(t_{j^*}) & \text{else} \end{cases}, \qquad \text{equation 11}$$

Referring again to FIG. 4, the start time optimizer 400 may include an objective-based optimizer 440. The objective-based optimizer 440 may include an objective manager 442 and a constraint manager 444. The objective based optimizer 440 may use the objective manager 442 and the constraint manager 444 to generate an optimization problem for which the solution is the schedule of times the HVAC equipment should be in active control and/or the temperature setpoints may be tightened. For example, the objective-based optimizer 440 may solve the optimization problem:

$$\phi^* = \underset{\phi}{\text{argmin}}\, J(\phi), \qquad \text{equation 12}$$

$$\text{s.t. } g(\phi) = 0, \qquad \text{equation 13}$$

$$h(\phi) \le 0, \qquad \text{equation 14}$$

where $J(\phi)$ is the objective function (e.g., cost function) as a function of the decisions $\phi$. For example, $\phi$ may be the heating and cooling setpoints at each time sample, a binary decision at each time sample representing if the temperature setpoints are relaxed, etc. $g(\phi)$ represents a number of equality constraints and $h(\phi) \le 0$ represents a number of inequality constraints. The objective-based optimizer 440 may solve the optimization problem using a nonlinear programming algorithm, a dynamic programming algorithm (e.g., by discretizing the temperature space) or by first converting the problem into a mixed-integer linear programming approximation of the nonlinear program.

The objective manger 442 may create a cost function that is related to the cost and/or the energy used by the HVAC equipment to maintain the temperature within the comfort bounds. For example, the objective manger 442 may use the cost function:

$$J(\phi) = \sum_{t \in h} \chi_t, \qquad \text{equation 15}$$

where h is the horizon over which the schedule is to be calculated and $\chi_t$ is a binary variable indicating time samples when the temperature setpoints are tightened or $$J(\phi) = \sum_{t \in h} r_{h,t} \chi_t^c + r_{h,t} \chi_t^h \qquad \text{equation 16}$$

where $\chi_t^c$ is a binary variable indicating time samples when the cooling temperature setpoint is tightened, $\chi_t^h$ is a binary variable indicating time samples when the cooling temperature setpoint is tightened and $r_{h,t}$, $r_{c,t}$ are respective weights related to the cost of tightening the heating setpoint or the cooling setpoint. For example, the $r_{h,t}$ may vary based on the price of natural gas, the efficiency of the heating equipment, etc. and $r_{c,t}$ may vary based on the price of electricity, the efficiency of the cooling equipment, etc.

The constraint manager 444 may create constraints that the temperatures through the horizon must satisfy. The constraints of equation 14 may be based on the temperature bounds. For example, the constraint manager 444 may receive occupancy schedules from the scheduler 412 and generate constraints that ensure the temperature is greater than or equal to the heating setpoint and less than or equal to the cooling setpoint during occupied time periods. The constraint manager 444 may also generate constraints during the unoccupied time periods that ensure the temperature is greater than or equal to a relaxed heating setpoint and less than or equal to a relaxed cooling setpoint during unoccupied time periods. In some embodiments, the constraint manager 444 is also configured to generate equality constraints that cause the temperature of the optimization problem to follow the model of equations 1-4. For example, the constraint manager 444 may generate constraints based on a discretization of the model equations 1-4:

$$f\Delta(T, T^h(\chi_t^h), T^c(\chi_t^c), t) - T_{t+1} = 0 \ \forall t \in h, \qquad \text{equation 17}$$

where $f_\Delta$ is the discrete time update equation equivalent to equations 1-4 for a sampling time $\Delta$.

It is noted that the equipment does not need to run at maximum capacity (e.g., maximum heating output or maximum cooling rejection). In some embodiments, the optimization is performed for multiple time update equations representing different maximum heating and cooling outputs. From the solutions to the optimization based on different maximum heating and cooling outputs one can be selected for implementation. The maximum heating and/or cooling output of the selected solution can be communicated to the equipment and/or controller to ensure that the heating and/or cooling output does not exceed this capability (e.g., even if the equipment has the capability). Advantageously, it is possible to optimize the start time based on satisfying the criterion as the occupied time period begins and to determine an optimal start time for equipment running at lower capacities (e.g., to reduce demand charges and/or to operate at an efficient level of heat production or heat rejection). Selecting the maximum capacity to be used may be performed by a second optimization process. For example, the capacity selection problem can be defined as a single variable optimization problem and solved using a golden section search algorithm. The second optimization process may determine the maximum percent capacity (e.g., heat production or rejection) that minimizes a cost function (e.g., a weighted objective of demand charge and energy usage).

Referring again to FIG. 4, the start time optimizer 400 may include an interface generator 438 in order to generate a user interface or to provide instructions to a client device 458 for generating a user interface related to the start time optimizer 400. The interface generator 438 can provide instructions to the client device 458 (e.g. JavaScript, Cascade Style Sheets) that instruct the client device how to generate the user interface within a client application (e.g., an internet browser, a proprietary application, etc.). In some embodiments, the interface generator 438 can provide application programming interfaces (APIs) that cause various functionality of the start time optimizer to be triggered. For example, the interface generator 438 may provide a user interface that executes a callback to an API that causes the start time optimizer 400 to update models 424 of the model manager 420 using newly acquired data. The interface generator 438 may also provide instructions for displaying the schedules calculated by the start time optimizer 400 (e.g., the transition time period, the preoccupancy time period, the time the HVAC equipment is to start active control, etc.).

Flow of Operations

Figure 9:
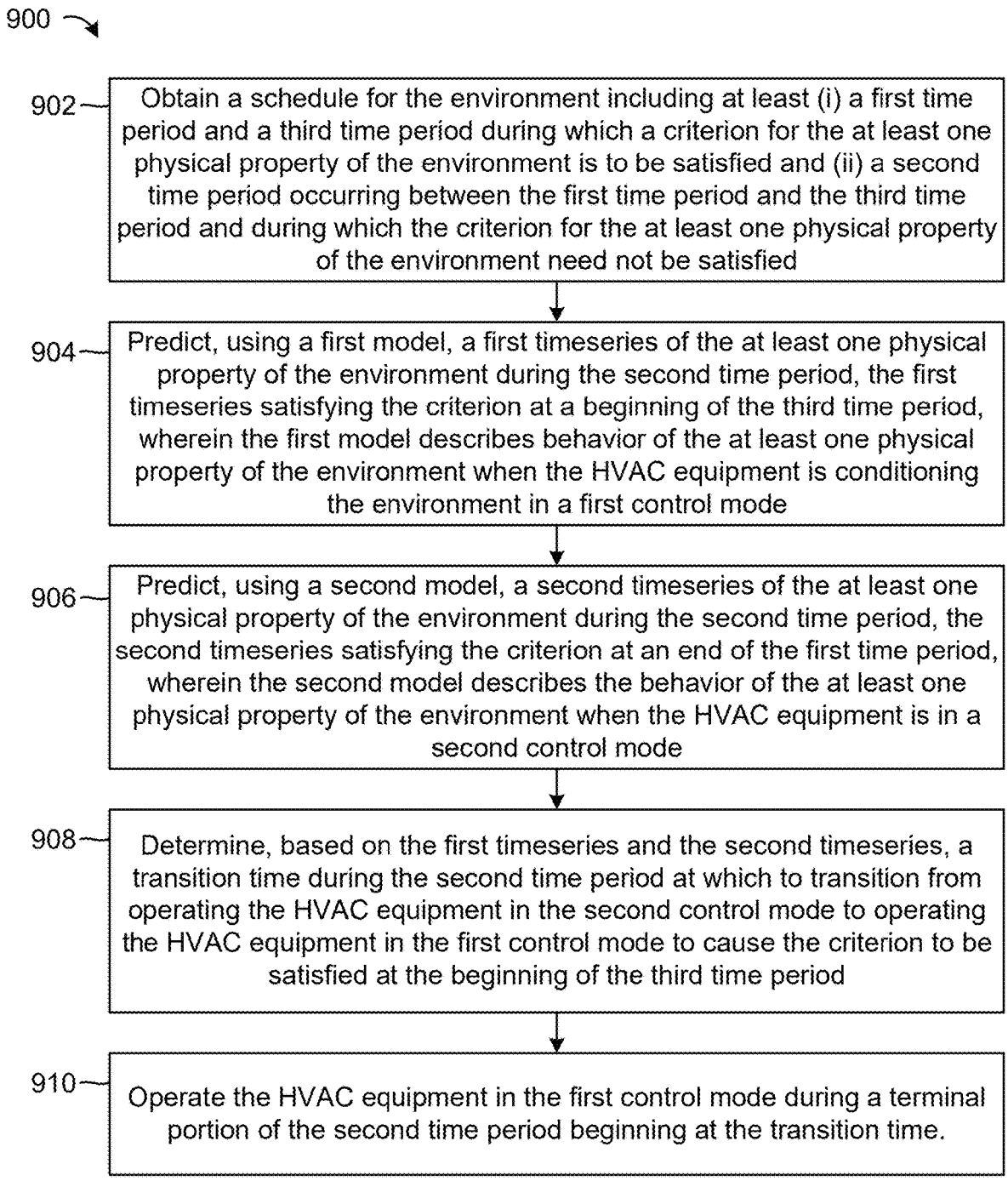
FIG. 9 is a flow diagram of a method for determining transition time period prior to occupancy during which the HVAC equipment should run, according to some embodiments.

FIG. 9 shows a flow of operations 900 for optimizing the start time of HVAC equipment according to some embodiments. The flow of operations 900 may include obtaining a schedule for the environment comprising at least (i) a first time period and a third time period during which a criterion for the at least one physical property of the environment is to be satisfied and (ii) a second time period occurring between the first time period and the third time period and during which the criterion for the at least one physical property of the environment need not be satisfied in operation 902. For example, the scheduler 412 may be configured to determine the times at which a condition (e.g., temperature, CO2, humidity, etc.) controlled by the HVAC equipment should meet a specified criterion (e.g., within a range, less than a threshold, etc.) according to some embodiments. In some embodiments, the first, second, and third time periods are consecutive. For example, the end time of the first time period may be the same as the start time of the second time period. Similarly, the end time of the second time period may be the same as the start time of the third time period.

The scheduler 412 may be configured to output time periods where the environment (e.g., space, zone, room, etc.) is expected to be occupied and therefore the HVAC equipment is to be controlled to cause the temperature to be within a comfort range and/or the ventilation equipment is to be controlled to cause the CO2 in the zone to be less than threshold (e.g. 800 ppm, 1000 ppm, etc.). The occupied time periods may represent the first and third time period during which the criterion of the at least one physical property (e.g., temperature, CO2, etc.) is to be satisfied. During unoccupied time periods, the criterion need not be met (e.g., the temperature can be setback to a higher cooling setpoint and/or a lower heating setpoint) The unoccupied time periods may represent the second time period that is between the first and third time periods. The scheduler 412 may be configured to determine the scheduled times for the condition to be met using various methodologies. For example, the scheduler 412 may receive schedules from a user interface (e.g., entered by an operator of the building environment), by subscribing for data through an API (e.g., subscribing to a calendar for a meeting room), using rule based approaches based on a variable that indicates occupancy (e.g., heat load, CO2, occupancy sensor output), or using machine learning techniques (e.g., a neural network, etc.) based on the variable that indicates occupancy.

In some embodiments, the flow of operations 900 includes predicting, using a first model, a first timeseries of the at least one physical property of the environment during the second time period in operation 904. The prediction in operation 904 may be performed subject to a constraint that requires the first timeseries to satisfy the criterion at a beginning of the third time period. The first model used in operation 904 may describe behavior of the at least one physical property of the environment when the HVAC equipment is conditioning the environment in a first control mode. The first control mode used in operation 904 may be a control mode that seeks to drive the physical property of the environment toward an occupied setpoint or range of values acceptable for occupied conditions (e.g., by actively operating the HVAC equipment to add/remove heat, humidity, CO2, etc. from the environment).

The simulation performed in operation 904 may simulate a trajectory of the physical property of the environment (represented by the first timeseries) that both (i) satisfies the criterion at the beginning of the third time period and (ii) is capable of being achieved by the HVAC equipment (e.g., is within the physical capabilities of the HVAC equipment based on their maximum operating capacities and the thermal characteristics of the environment) as indicated by the first model. For example, the simulator 432 may be used to perform a backwards simulation from the beginning of the third time period where the physical condition (e.g., temperature, CO2, etc.) is satisfying the criterion. The first timeseries may include a set of values of the physical condition that move progressively closer to the criterion as time elapses during the second time period and satisfy the criterion at the beginning of the third time period. This ensures that the HVAC equipment are capable of driving the physical condition from the values defined by the first timeseries to the criterion by the beginning of the third time period.

As one example of the simulation performed in operation 904, the first timeseries may be the set of values represented by the simulated temperature 710*a* shown in FIG. 8A or the simulated temperature 708*b* shown in FIG. 8B. The timeseries represented by the simulated temperatures 710*a* and 708*b* may be generated by performing a backward simulation of the temperature of the environment from the beginning of the third time period, at which time the temperature of the environment should satisfy the temperature constraints 702*a* and 704*a*. The simulated temperatures 710*a* and 708*b* represent feasible and/or optimal paths that could be achieved by operating the HVAC equipment during the second time period to ensure that the temperature constraints 702*a* and 704*a* are satisfied at the beginning of the third time period.

The simulator 432 may use a model represented by equations 1 and 2 or 1 and 3 depending on the mode of the HVAC equipment (e.g., heating mode or cooling mode). In some embodiments, the simulator 432 begins the simulations small amount away from the desired comfort bound (e.g., 0.5° F.) to account for the model's asymptotic nature. The criterion that is to be satisfied at the beginning of the third period may be considered the comfort bound plus or minus (e.g., depending on the heating or cooling mode) the small amount.

The flow of operations 900 may include predicting, using a second model, a second timeseries of the at least one physical property of the environment during the second time period in operation 906. The prediction in operation 906 may be performed subject to a constraint that requires the second timeseries to satisfy the criterion at an end of the first time period. The second model used in operation 906 may describe the behavior of the at least one physical property of the environment when the HVAC equipment is in a second control mode. The second control mode used in operation 906 may be a control mode that allows the physical property of the environment to drift away from an occupied setpoint or range of values acceptable for occupied conditions (e.g., by not operating the HVAC equipment to add/remove heat, humidity, CO2, etc. from the environment, or operating the HVAC equipment in a manner that allows the physical property of the environment to move away from the criterion).

The simulation performed in operation 906 may simulate a trajectory of the physical property of the environment (represented by the second timeseries) that both (i) satisfies the criterion at the end of the first time period and (ii) complies with a feasible evolution of the physical property of the environment permitted by the second model when the HVAC equipment are operated according to the second control mode. For example, the simulator 432 may be used to perform a forward simulation from the end of the first time period where the physical condition (e.g., temperature, CO2, etc.) is satisfying the criterion. The second timeseries may include a set of values of the physical condition that satisfy the criterion at the end of the first time period and move progressively away from the criterion as time elapses during the second time period.

As one example of the simulation performed in operation 906, the second timeseries may be the set of values represented by the simulated temperature 706*a* shown in FIG. 8A or the simulated temperature 706*b* shown in FIG. 8B. The timeseries represented by the simulated temperatures 706*a* and 706*b* may be generated by performing a forward simulation of the temperature of the environment from the end of the first time period, at which time the temperature of the environment should satisfy the temperature constraints 702*a* and 704*a*. The simulated temperatures 706*a* and 706*b* represent feasible paths that the temperature of the space could take during the second time period if allowed to drift away from the temperature constraints 702*a* and 704*a* starting at the end of the first time period.

The forward simulation from the end of the first time period may start from the bounds of the criteria (e.g., one of the temperature bounds) or it may begin from the a value away from the bounds, but still satisfying the criterion. For example, conditions (e.g., loads, etc.) may be such that that HVAC equipment does not have to add heat or reject heat from the environment to cause the temperature constraints to be satisfied and the temperature may be between the bounds that the end of the first time period, and still satisfying the criterion. The simulator 432 may use a model represented by equations 1 and 4 to perform the forward simulation from the end of the first time period.

The flow of operations 900 may include determining, based on the first timeseries and the second timeseries, a transition time during the second time period at which to transition from operating the HVAC equipment in the second control mode to operating the HVAC equipment in the first control mode to cause the criterion to be satisfied at the beginning of the third time period in operation 906. For example, the comparison-based optimizer 434 may determine at what time the two timeseries coincide (e.g., have the same value) to identify the beginning of the transition time.

As one example of the determination performed in operation 908, the comparison-based optimizer 434 may determine the time during the second time period at which the simulated temperature 710*a* and simulated temperature 706*a* shown in FIG. 8A have the same value. For example, the comparison-based optimizer 434 may determine the temperature-time point at which the simulated temperature 710*a* and simulated temperature 706*a* intersect. This point represents the maximum amount that the temperature of the environment is allowed to drift away from the temperature constraint 702*a* during the second time period to ensure that the HVAC equipment can drive the temperature back to the temperature constraint 702*a* in the amount of time remaining in the second time period. If the temperature of the environment were allowed to continue increasing beyond this temperature-time point during the second time period (e.g., along the portion of the simulated temperature 706*a* that occurs within time period 716*a*), the HVAC equipment would not be capable of achieving the temperature constraint 702*a* by the beginning of the third time period. Accordingly, the temperature-time point defined by the intersection of the two simulated temperatures 706*a* and 710*a* represents the point at which the HVAC equipment should begin operating in the first control mode to ensure that the temperature constraint 702*a* is satisfied at the beginning of the third time period.

As another example of the determination performed in operation 908, the comparison-based optimizer 434 may determine the time during the second time period at which the simulated temperature 708*b* and simulated temperature 706*b* shown in FIG. 8B have the same value. For example, the comparison-based optimizer 434 may determine the temperature-time point at which the simulated temperature 708*b* and simulated temperature 706*b* intersect. This point represents the maximum amount that the temperature of the environment is allowed to drift away from the temperature constraint 704*b* during the second time period to ensure that the HVAC equipment can drive the temperature back to the temperature constraint 704*b* in the amount of time remaining in the second time period. If the temperature of the environment were allowed to continue decreasing beyond this temperature-time point during the second time period (e.g., along the portion of the simulated temperature 706*b* that occurs within time period 716*b*), the HVAC equipment would not be capable of achieving the temperature constraint 704*b* by the beginning of the third time period. Accordingly, the temperature-time point defined by the intersection of the two simulated temperatures 708*b* and 706*b* represents the point at which the HVAC equipment should begin operating in the first control mode to ensure that the temperature constraint 704*b* is satisfied at the beginning of the third time period.

In some embodiments, the simulations use discrete time equations and the first and second timeseries are discrete time series. If the timeseries are discrete, the samples two timeseries may never have exactly the same value as the intersection time could be between to samples. To determine the beginning of the transition time period, the comparison-based optimizer 434 may determine the difference between the two timeseries and determine the times where the difference changes sign (e.g., negative to positive or positive to negative). Interpolation of the two timeseries using the samples at the times identified from the sign change may be performed to find an accurate approximation of the time of intersection or coincidence. The approximation may be used to identify the beginning of the transition time. In some embodiments, the first sampling time of the two times found where the difference changes sign may be used as an approximation of the time of intersection or coincidence. Using the first time may cause the equipment to turn slightly earlier than necessary, but provides a small amount of extra time for the HVAC equipment to cause the physical property of the environment to satisfy the criteria before the beginning of the third time period.

The flow of operations 900 may include operating the HVAC equipment in the first control mode during a terminal portion of the second time period beginning at the transition time in operation 910. For example, at the beginning of the transition time period the start time optimizer 400 may send signals to the HVAC equipment and/or a controller of the HVAC equipment indicating that it is time to begin conditioning (e.g., heat or cool) the space. The control signals may include a start command, a temperature setpoint, or any other command that may be used to initialize building control. After receiving the initialization from the start time optimizer 400 the controller operating the HVAC equipment (e.g., the same controller implementing the start time optimizer 400, a second controller, a supervisory controller, etc.) may determine control signals to send to the actuators (e.g., valves, valve motors, dampers, damper motors, fan enables, fan variable speed drives, etc.) of the HVAC equipment. The controller may send control signals including positions, percent openings, speeds, and/or any other type of control signal that may be used to affect a variable or condition of the space. In some embodiments, control is split between multiple computer hardware, devices, and/or controllers (e.g., similar to the controller 230). A first controller, including the start time optimizer 400, generates an on/off control signal or active/inactive control signal and communicates the information to another controller. The first controller, including the start time optimizer 400, may indirectly affect the variable or condition of the space by initiating control of the space.

Figure 10:
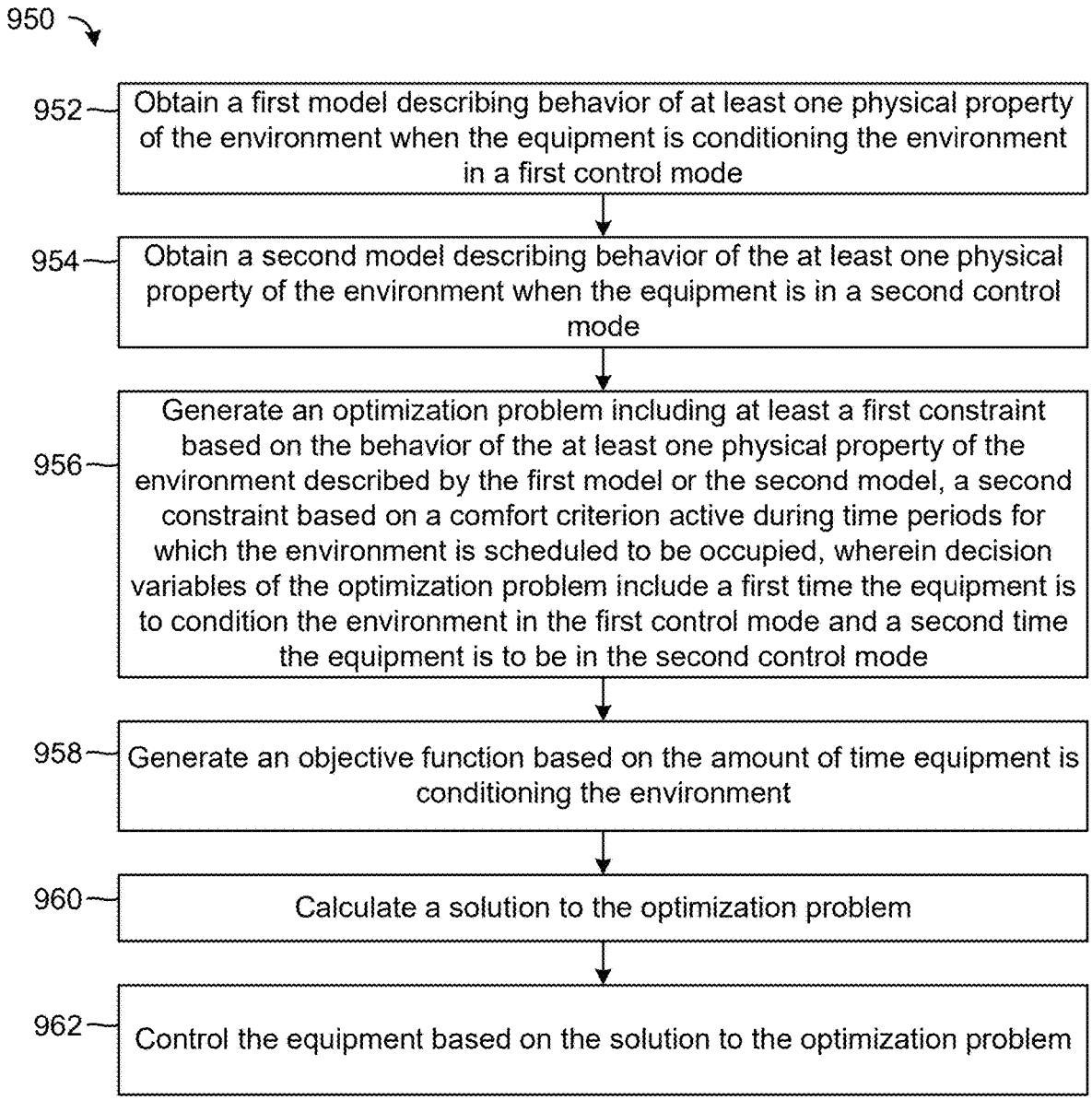
FIG. 10 is a flow diagram of a method for determining transition time period prior to occupancy during which the HVAC equipment should run using an optimization algorithm, according to some embodiments.

FIG. 10 shows flow of operations 950 for optimizing the start time of HVAC equipment according to some embodiments. The flow of operations 950 may include obtaining a first model describing behavior of at least one physical property of the environment when the equipment is conditioning the environment in a first control mode in operation 952 and obtaining a second model describing behavior of the at least one physical property of the environment when the equipment is in a second control mode in operation 952. For example, the model manager 420 may provide a model based on equations 1-3 to represent the behavior of the temperature (e.g., a physical property) of the environment during when the HVAC equipment is conditioning the space. A model based on equations 1 and 4 may be provided for the second control mode (e.g., widened temperature setpoints, or when the HVAC is otherwise not providing heating or cooling to the space).

In some embodiments, the flow of operations 950 may include generating an optimization problem comprising at least a first constraint based on the behavior of the at least one physical property of the environment described by the first model or the second model, a second constraint based on a comfort criterion active during time periods for which the environment is scheduled to be occupied, wherein decision variables of the optimization problem comprise a first time the equipment is to condition the environment in the first control mode and a second time the equipment is to be in the second control mode in operation 956. For example, the objective-based optimizer 440 may generate an optimization problem using the objective manager 442 and the constraint manager 444.

The objective manger 442 may create a cost function that is related to the cost and/or the energy used by the HVAC equipment to maintain the temperature within the comfort bounds. For example, the objective manger 442 may use the cost function shown in equation 15 or 16. The cost function may approximate the cost associated with operating the HVAC equipment. For example, the cost function may include the amount of time the HVAC equipment is actively controlling to a setpoint. In some embodiments, the amount of time the HVAC equipment is actively controlling may be weighted based on efficiency of the HVAC equipment and/or the cost of the fuel or energy used to power the HVAC equipment.

The constraint manager 444 may create constraints that the temperatures through the horizon must satisfy. The constraints of equation 14 may be based on the temperature bounds. For example, the constraint manager 444 may receive occupancy schedules from the scheduler 412 and generate constraints that ensure the temperature is greater than or equal to the heating setpoint and less than or equal to the cooling setpoint during occupied time periods. The constraint manager 444 may also generate constraints during the unoccupied time periods that ensure the temperature is greater than or equal to a relaxed heating setpoint and less than or equal to a relaxed cooling setpoint during unoccupied time periods. In some embodiments, the constraint manager 444 is also configured to generate equality constraints that cause the temperature of the optimization problem to follow the model of equations 1-4. For example, the constraint manager 444 may generate constraints based on a discretization of the models provided in operations 952 and 954.

In some embodiments, the flow of operations 950 includes calculating a solution to the optimization problem in operation 960. The objective-based optimizer 440 may solve the optimization problem using a nonlinear programming algorithm, a dynamic programming algorithm (e.g., by discretizing the temperature space) or by first converting the problem into a mixed-integer linear programming approximation of the nonlinear program.

The flow of operations 950 may include controlling the equipment based on the solution to the optimization problem in operation 962. The solution of the optimization problem may include the times that the HVAC equipment is to be in active control (e.g., with tightened heating or cooling setpoints). The start time optimizer 400 may send signals to the HVAC equipment and/or a controller of the HVAC equipment indicating that it is time to begin conditioning (e.g., heat or cool) the space based on the times included in the solution to the optimization problem. The control signals may include a start command, a temperature setpoint, or any other command that may be used to initialize building control. After receiving the initialization from the start time optimizer 400 the controller operating the HVAC equipment (e.g., the same controller implementing the start time optimizer 400, a second controller, a supervisory controller, etc.) may determine control signals to send to the actuators (e.g., valves, valve motors, dampers, damper motors, fan enables, fan variable speed drives, etc.) of the HVAC equipment. The controller may send control signals including positions, percent openings, speeds, and/or any other type of control signal that may be used to affect a variable or condition of the space. In some embodiments, control is split between multiple computer hardware, devices, and/or controllers (e.g., similar to the controller 230). A first controller, including the start time optimizer 400, generates an on/off control signal or active/inactive control signal and communicates the information to another controller. The first controller, including the start time optimizer 400, may indirectly affect the variable or condition of the space by initiating control of the space.

Figure 11:
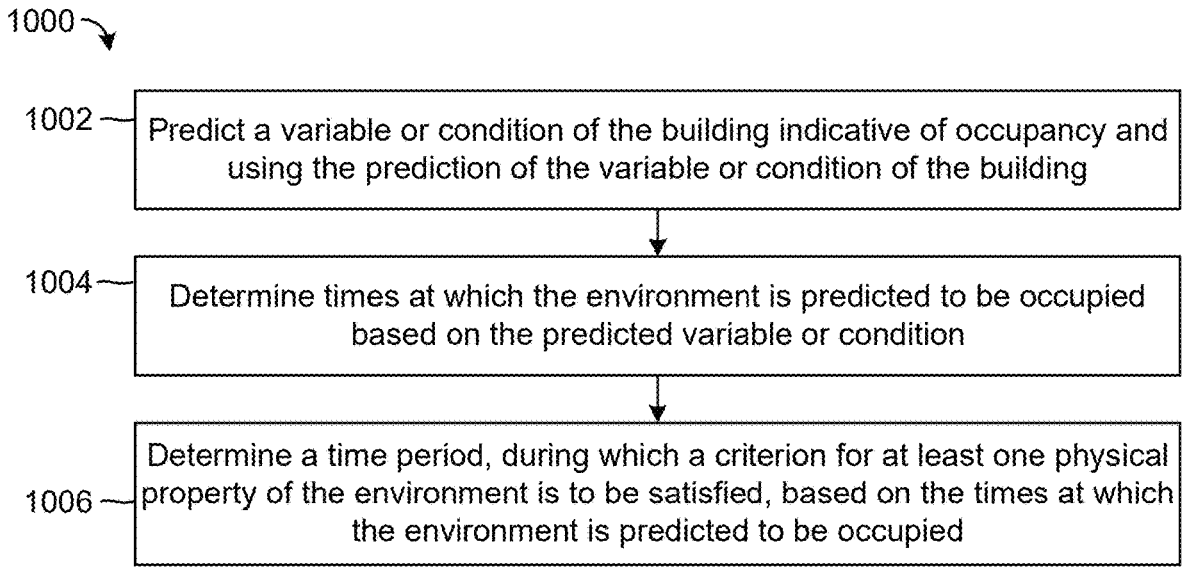
FIG. 11 is a flow diagram of a method for predicting the occupied time periods of an environment, according to some embodiments.

FIG. 11 shows flow of operations 1000 for determining an occupancy schedule according to some embodiments. The flow of operations 1000 may include predicting a variable or condition of the building indicative of occupancy and using the prediction of the variable or condition of the building in operation 1002. For example, The load predictor 414 may predict a timeseries over a future prediction horizon and based on the current load and the current/forecasted weather. Additionally or alternatively, the load predictor may predict the CO2 concentration within the environment as an indication of the occupancy.

In some embodiments, the flow of operations 1000 includes determining times at which the environment is predicted to be occupied based on the predicted variable or condition in operation 1004 and a determining a time period (e.g., the first and/or third time period of flow of operations 900), during which a criterion for at least one physical property of the environment is to be satisfied, based on the times at which the environment is predicted to be occupied. For example, the occupancy identifier 416 includes a number of criteria used to determine if the load (or other indicator of occupancy) is representative of an occupied time period. The occupancy identifier 416 may additionally calculate the derivative of the load prediction (e.g., using a finite difference equation) an determine if the derivative satisfies certain criteria. For example, the occupancy identifier 416 may consider the start of occupancy any time the derivative of the load prediction is greater than a first threshold for a first number of samples and the load prediction is greater than a second threshold. Similarly, the occupancy identifier 416 may consider the end of occupancy any time the derivative of the load prediction is more negative than a third threshold for a second number of samples and the load prediction is less than a fourth threshold. The occupancy identifier 416 may be similarly used to determine the current occupancy status (e.g., using recent past data of the load or previous predictions of the load) or the occupancy identifier 416 may use a different source of current occupancy data (e.g., an occupancy sensor).

In some embodiments, the occupancy identifier 416 includes an artificial intelligence (AI) model, for example, to determine the occupied time periods. The AI model may be any type of machine learning architecture including, but not limited to, neural networks, convolutional neural networks, transformer models, recurrent neural networks, long-short term models, etc. The parameters (e.g., weights) of the AI model may be found using the training data with historical load profiles and historical occupancy profiles and any objective function related to the determination (e.g., classification) of time periods between occupied and unoccupied states as described previously. Additionally or alternatively, the functionality of the load predictor 414 and the occupancy identifier 416 can be combined into a single AI model that generates the occupancy schedule based on the time of day, the weather conditions and forecasts, the current load, and/or any other variables that are determined to be indicative of occupancy. In some embodiments, historical occupancy data (e.g., obtained from an occupancy sensor) is used to train an occupancy predictor based on time of day, day of week, the current occupancy state, etc.

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied and the nature or number of discrete elements or positions can be altered or varied. Accordingly, all such modifications are intended to be included within the scope of the present disclosure. The order or sequence of any process or method steps can be varied or re-sequenced according to alternative embodiments. Other substitutions, modifications, changes, and omissions can be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure can be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps can be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A heating, ventilating, or air conditioning (HVAC) system that operates HVAC equipment to affect at least one physical property of an environment of a building zone, the HVAC system comprising:

one or more memory devices having instructions stored thereon that, when executed by one or more processors, cause the one or more processors to perform operations comprising:

obtaining a schedule for the environment comprising at least (i) a first time period and a third time period during which a criterion for the at least one physical property of the environment is to be satisfied and (ii) a second time period occurring between the first time period and the third time period and during which the criterion for the at least one physical property of the environment need not be satisfied;

determining a transition time during the second time period at which to start pre-conditioning the environment based on an intersection of (i) a first timeseries comprising predicted values of the physical property when the HVAC equipment are operated in a first control mode during the second time period and satisfying the criterion at a beginning of the third time period, wherein the first timeseries is initialized at the beginning of the third time period and determined by backward simulation using a thermal model of the building zone and (ii) a second timeseries comprising predicted values of the physical property when the HVAC equipment are operated in a second control mode during the second time period and satisfying the criterion at an end of the first time period, the intersection defining a temperature-time point at which the predicted values of the physical property in the first timeseries and the second timeseries are equal; and operating the HVAC equipment in the first control mode during a terminal portion of the second time period beginning at the transition time.

2. The HVAC system of claim 1, wherein the first control mode comprises controlling the at least one physical property towards a value of a setpoint and the second control mode comprises at least one of:

the equipment being off;

the equipment not controlling the at least one physical property towards the value of the setpoint; or the equipment not affecting the at least one physical property of the environment.

3. The HVAC system of claim 1, wherein the at least one physical property comprises at least one of a temperature, a humidity, or a carbon dioxide level and the environment is a space of a building.

4. The HVAC system of claim 3, wherein a form of a first model used to generate the predicted values of the first timeseries or a form of a second model is used to generate the predicted values of the second timeseries chosen based on physical characteristics of the space, wherein the first model is the thermal model of the building zone and predicts the values of the physical property in the first timeseries based on predicted amounts of heat transfer between the building zone and the HVAC equipment when operated in the first control mode.

5. The HVAC system of claim 4, further comprising determining parameters of the first model or the second model using at least one of:

historical behavior of the environment;

a configuration of the equipment; or a manufacturer specification of the equipment.

6. The HVAC system of claim 5, the operations further comprising predicting a variable or condition of the building indicative of occupancy and using the prediction of the variable or condition of the building to determine times at which the environment is predicted to be occupied.

7. The HVAC system of claim 6, wherein the variable or condition of the building indicative of occupancy is a load for the HVAC equipment.

8. The HVAC system of claim 1, wherein the environment was or is predicted to be occupied during the first time period and the third time period and the environment is predicted to be unoccupied during the second time period.

9. The HVAC system of claim 1, wherein the criterion is satisfied when the at least one physical property is within a range comprising a target value of the at least one physical property.

10. The HVAC system of claim 1, wherein determining the transition time during the second time period based on the first timeseries and the second timeseries comprises determining a time at which the first timeseries and the second timeseries coincide.

11. A method for controlling HVAC equipment to affect at least one physical property of an environment of a building zone, the method comprising: obtaining a schedule for the environment comprising at least (i) a first time period and a third time period during which a criterion for the at least one physical property of the environment is to be satisfied and (ii) a second time period occurring between the first time period and the third time period and during which the criterion for the at least one physical property of the environment need not be satisfied;

determining a transition time during the second time period at which to start pre-conditioning the environment based on an intersection of (i) a first timeseries comprising predicted values of the physical property when the HVAC equipment are operated in a first control mode during the second time period and satisfying the criterion at a beginning of the third time period, wherein the first timeseries is initialized at the beginning of the third time period and determined by backward simulation using a thermal model of the building zone and (ii) a second timeseries comprising predicted values of the physical property when the HVAC equipment are operated in a second control mode during the second time period and satisfying the criterion at an end of the first time period, the intersection defining a temperature-time point at which the predicted values of the physical property in the first timeseries and the second timeseries are equal; and operating the HVAC equipment in the first control mode during a terminal portion of the second time period beginning at the transition time.

12. The method of claim 11, wherein the first control mode comprises controlling the at least one physical property towards a value of a setpoint and the second control mode comprises at least one of:

the equipment being off;

the equipment not controlling the at least one physical property towards the value of the setpoint; or the equipment not affecting the at least one physical property of the environment.

13. The method of claim 11, further comprising predicting a load for the HVAC equipment, using the prediction of the load or condition of a building to determine times at which the environment is predicted to be occupied, and determining the third time period based on the times at which the environment is predicted to be occupied.

14. The method of claim 11, wherein the criterion is satisfied when the at least one physical property is within a range comprising a target value of the at least one physical property.

15. The method of claim 11, wherein determining the transition time during the second time period based on the first timeseries and the second timeseries comprises determining a time at which the first timeseries and the second timeseries coincide.

16. One or more non-transitory computer-readable media having instructions stored thereon that, when executed by one or more processors, cause the one or more processors to perform operations comprising:

obtaining a schedule for an environment of a building zone comprising at least (i) a first time period and a third time period during which a criterion for at least one physical property of the environment is to be satisfied and (ii) a second time period occurring between the first time period and the third time period and during which the criterion for the at least one physical property of the environment need not be satisfied; determining a transition time during the second time period at which to start pre-conditioning the environment based on an intersection of (i) a first timeseries comprising predicted values of the physical property when HVAC equipment are operated in a first control mode during the second time period and satisfying the criterion at a beginning of the third time period, wherein the first timeseries is initialized at the beginning of the third time period and determined by backward simulation using a thermal model of the building zone and (ii) a second timeseries comprising predicted values of the physical property when the HVAC equipment are operated in a second control mode during the second time period and satisfying the criterion at an end of the first time period, the intersection defining a temperature-time point at which the predicted values of the physical property in the first timeseries and the second timeseries are equal; and operating the HVAC equipment in the first control mode during a terminal portion of the second time period beginning at the transition time.

17. The one or more non-transitory computer-readable media of claim 16, wherein the first control mode comprises controlling the at least one physical property towards a value of a setpoint and the second control mode comprises at least one of:

the equipment being off;

the equipment not controlling the at least one physical property towards the value of the setpoint; or the equipment not affecting the at least one physical property of the environment.

18. The one or more non-transitory computer-readable media of claim 16, wherein the at least one physical property comprises at least one of a temperature, a humidity, or a carbon dioxide level and the environment is a space of a building.

19. The one or more non-transitory computer-readable media of claim 18, wherein a form of a first model used to generate the predicted values of the first timeseries or a form of a second model is used to generate the predicted values of the second timeseries chosen based on physical characteristics of the space, wherein the first model is the thermal model of the building zone and predicts the values of the physical property in the first timeseries based on predicted amounts of heat transfer between the building zone and the HVAC equipment when operated in the first control mode.

20. The one or more non-transitory computer-readable media of claim 19, further comprising determining parameters of the first model or the second model using at least one of:

historical behavior of the environment;

a configuration of the equipment; or a manufacturer specification of the equipment.

* * * * *